US011333002B2

(12) United States Patent
Macek et al.

(10) Patent No.: US 11,333,002 B2
(45) Date of Patent: May 17, 2022

(54) COMPLETION SYSTEMS AND METHODS TO PERFORM COMPLETION OPERATIONS

(71) Applicant: Halliburton Energy Services, Inc., Houston, TX (US)

(72) Inventors: Mark Douglas Macek, Tyler, TX (US); Colin E. Kappe, Covington, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 16/776,270

(22) Filed: Jan. 29, 2020

(65) Prior Publication Data

US 2021/0230972 A1 Jul. 29, 2021

(51) Int. Cl.
*E21B 34/10* (2006.01)
*E21B 43/08* (2006.01)
(Continued)

(52) U.S. Cl.
CPC ..... *E21B 34/10* (2013.01); *E21B 43/08* (2013.01); *E21B 43/045* (2013.01); *E21B 43/26* (2013.01); *E21B 2200/06* (2020.05)

(58) Field of Classification Search
CPC ..... E21B 34/10; E21B 43/08; E21B 2200/06; E21B 43/045; E21B 43/26
See application file for complete search history.

(56) References Cited

U.S. PATENT DOCUMENTS 2,846,015 A 8/1958 Pittman
3,288,221 A * 11/1966 Howard ..... E21B 33/1294 166/183
(Continued)

FOREIGN PATENT DOCUMENTS

CA 2838552 5/2016
WO 2009015109 A1 1/2009
(Continued)

OTHER PUBLICATIONS

International Search Report and Written Opinion for corresponding International PCT Patent Application No. PCT/US2020/017650; dated Oct. 27, 2020.
(Continued)

*Primary Examiner* — Dany E Akakpo
(74) *Attorney, Agent, or Firm* — McGuireWoods LLP

(57) ABSTRACT

Completion Systems and Methods to Perform Completion Operations are disclosed. A completion system includes a tubular having a wall that defines a flowbore within the tubular and extending into a zone of an annular region external to the tubular. The completion system also includes a first port disposed in the wall and configured to provide fluid communication between the flowbore and the annular region, and a communication path disposed at least partially within the wall and configured to provide fluid communication with an annulus of a well outside of the zone. The completion system further includes a second port disposed in the wall and configured to provide fluid communication between the flowbore and the communication path, a cover disposed over the second port and configured to prevent fluid communication during a fracturing operation, and a diverter seat disposed in the flowbore of the tubular uphole of the second port.

30 Claims, 13 Drawing Sheets

(51) Int. Cl.
*E21B 43/04* (2006.01)
*E21B 43/26* (2006.01)

(56) References Cited

U.S. PATENT DOCUMENTS

| | | | |
|---|---|---|---|
| 5,048,611 | A | 9/1991 | Cochran |
| 5,443,117 | A | 8/1995 | Ross |
| 5,960,881 | A | 10/1999 | Allamon et al. |
| 6,082,459 | A | 7/2000 | Rogers et al. |
| 6,182,766 | B1 | 2/2001 | Rogers et al. |
| 6,782,948 | B2 | 8/2004 | Echols et al. |
| 7,322,417 | B2 | 1/2008 | Rytlewski et al. |
| 7,387,165 | B2 | 6/2008 | Lopez De Cardenas et al. |
| 7,464,759 | B1 * | 12/2008 | Wintill ..... E21B 34/10 166/305.1 |
| 7,735,559 | B2 | 6/2010 | Malone |
| 8,342,245 | B2 | 1/2013 | Richard et al. |
| RE45,641 | E | 8/2015 | Henriksen et al. |
| 9,359,877 | B2 | 6/2016 | Stout |
| 9,416,643 | B2 | 8/2016 | Purkis et al. |
| 10,669,820 | B2 | 6/2020 | Smith et al. |
| 2002/0117301 | A1 | 8/2002 | Womble |
| 2003/0070809 | A1 | 4/2003 | Schultz et al. |
| 2005/0279501 | A1 | 12/2005 | Surjaatmadja et al. |
| 2006/0108115 | A1 | 5/2006 | Johnson |
| 2006/0243440 | A1 | 11/2006 | Corbett et al. |
| 2008/0314589 | A1 | 12/2008 | Guignard et al. |
| 2009/0025923 | A1 | 1/2009 | Patel et al. |
| 2010/0243243 | A1 | 9/2010 | Chen et al. |
| 2010/0294495 | A1 | 11/2010 | Clarkson et al. |
| 2013/0014953 | A1 | 1/2013 | van Petegem |
| 2014/0083766 | A1 | 3/2014 | Tips et al. |
| 2015/0075807 | A1 | 3/2015 | Allen et al. |
| 2015/0122493 | A1 | 5/2015 | Wood et al. |
| 2015/0136392 | A1 | 5/2015 | Jackson et al. |
| 2015/0192001 | A1 | 7/2015 | Hall |
| 2015/0211334 | A1 | 7/2015 | Richards |
| 2016/0003002 | A1 | 1/2016 | Aitken |
| 2016/0145972 | A1 | 5/2016 | Allen et al. |
| 2016/0281459 | A1 | 9/2016 | Stautzenberger et al. |
| 2016/0333679 | A1 | 11/2016 | Getzlaf et al. |
| 2017/0058636 | A1 | 3/2017 | Wood et al. |
| 2018/0073329 | A1 | 3/2018 | Nordheimer |
| 2018/0094508 | A1 | 4/2018 | Smith et al. |
| 2018/0266212 | A1 * | 9/2018 | Koch ..... E21B 34/12 |
| 2018/0306002 | A1 | 10/2018 | Williamson, Jr. et al. |
| 2018/0347312 | A1 | 12/2018 | Green et al. |
| 2019/0249520 | A1 | 5/2019 | Merron et al. |
| 2020/0149378 | A1 | 5/2020 | van Petegem et al. |
| 2021/0025262 | A1 * | 1/2021 | Smith ..... E21B 34/063 |

FOREIGN PATENT DOCUMENTS

| | | | |
|---|---|---|---|
| WO | 2009073391 | A2 | 6/2009 |
| WO | 2011150048 | A1 | 12/2011 |
| WO | 2014011148 | A1 | 1/2014 |
| WO | 2018215747 | A1 | 11/2018 |

OTHER PUBLICATIONS

International Search Report and Written Opinion for related International PCT Patent Application No. PCT/US2020/017648; dated Oct. 20, 2020.

* cited by examiner

COMPLETION SYSTEMS AND METHODS TO PERFORM COMPLETION OPERATIONS

BACKGROUND

The present disclosure relates generally to completion systems and methods to perform completion operations.

A completion system is sometimes deployed in a wellbore during fracturing, gravel packing, and other operations to complete the wellbore. Some completion systems utilize dissolvable balls to actuate sleeves and to open or close ports during different operations. However, it is sometimes difficult to accurately predict the dissolution rate as well as other factors related to the dissolution of the dissolvable balls in a downhole environment.

BRIEF DESCRIPTION OF THE DRAWINGS

Illustrative embodiments of the present disclosure are described in detail below with reference to the attached drawing figures, which are incorporated by reference herein, and wherein:

FIG. 2' is a cross-sectional, zoomed-in view of a completion system similar to the completion system of FIG. 2;

FIG. 3C' illustrates an operation where a fluid is circulated through the completion system of FIG. 2' after a cover that covers a first port is shifted to provide fluid communication from the flowbore to a zone of the annular region;

FIG. 3D' illustrates an operation where a reverse fluid flowing out of a second port of the completion system of FIG. 3C' dislodges the ball from the diverter seat and carries the ball uphole after a cover that covers the second port is shifted to provide fluid communication through the second port;

Figure 1:
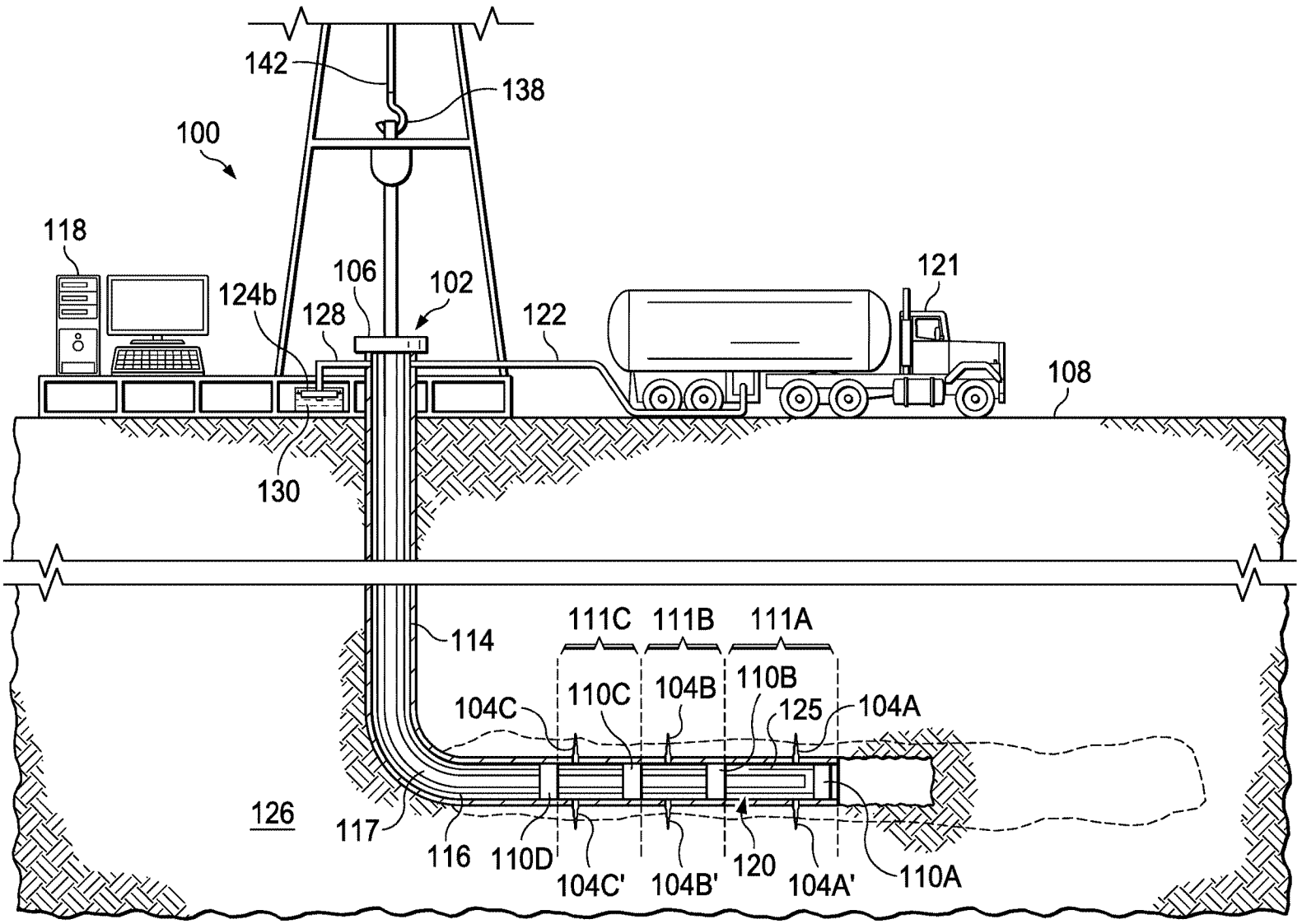
FIG. 1 is a schematic, side view of a completion environment that includes a wellbore having a completion system deployed in the wellbore during completion of the wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to completion systems and methods to perform completion operations. Completion systems described herein are deployable in open-hole and cased-hole wellbores. Further, completion systems deployed herein are configured to deploy in a single zone or across multiple zones of a wellbore. A completion system includes a tubular that is deployed in a wellbore of a well, such as the well illustrated in FIG. 1. As referred to herein, a tubular may be a coiled tubing, a drill pipe, a production tubing, or another type of conveyance that has an inner diameter that forms a flowbore for fluids and solid particles and components (e.g., diverters) to pass through. The tubular extends across one or more zones of an annular region defined between the tubular and the wellbore. The completion system also includes a communication path that is at least partially disposed within the tubular wall and configured to provide fluid communication across the one or more zones. In some embodiments, the communication path is partially or completely formed from any combination of one or more from tubes that straddle filters of the completion system, one or more concentric pipes, and one or more machined flow paths through one or more sleeves of the completion system.

For a single zone completion system, the completion system includes a diverter seat disposed in the zone and configured to hold a diverter dropped downhole through the flowbore. As referred to herein, a diverter seat is any device configured to temporarily catch a diverter that is deployed in the flowbore to prevent the diverter from flowing further downhole. Examples of diverter seats include, but are not limited to, ball seats, dart seats, and plug seats, whereas examples of diverters include, but at not limited to, balls, darts, and plugs that are deployable in the flowbore.

The completion system includes a port (e.g., a fracture port) that is disposed in a wall of the tubular. Further, the fracture port is configured to provide fluid communication between the flowbore and the annular region. In some embodiments, the completion system also includes a cover that is configured to initially prevent fluid communication through the fracture port. As referred to herein, a cover is any device or component configured to prevent fluid communication through a port. In some embodiments, a cover is shiftable from a first position, which prevents fluid communication through the port, to a second position to allow fluid communication through the port. In some embodiments, the cover is a sleeve that is configured to prevent fluid communication through the fracture port while in one position, and is configured to allow fluid communication through the fracture port while in a second position. Prior to a fracturing operation, a diverter flows downhole until the diverter lands on the diverter seat, which shifts the cover, thereby uncovering the fracture port, and cutting off a portion of the communication path downhole from the cover (e.g., below the cover). Additional descriptions of operations performed to uncover the fracture port and cutoff the communication path are provided in the paragraphs below and are illustrated in at least FIG. 3B.

A fluid is pumped downhole through the flowbore, into the fracture port, and into the annular region. In some embodiments, the fluid is a fracture fluid used in a fracturing operation. In some embodiments, fluid in the annular region passes through a filter configured to filter solid particles greater than a threshold size, into a second tubular (e.g., a dehydration tube), and back into the communication path (portion of the communication path above the cutoff), where the fluid flows through the communication path uphole. In some embodiments, where a gravel packing operation is performed in the annular region, the second tubular is a dehydration tube configured to take return fluid from the annular region to dehydrate gravel packs in the annular region during and after a gravel packing operation.

The completion system also includes a second port (e.g., a reverse port) that is also disposed in the tubular wall and further downhole from the location of the fracture port. In some embodiments, the completion system also includes a second cover (e.g., a reverse sleeve) that is initially configured to cover the reverse port to prevent fluid communication through the reverse port. In some embodiments, the completion system also includes a second cover that is configured to initially cover the reverse port during fracturing and gravel packing operations. In some embodiments, the reverse sleeve is configured to shift to a second position to allow fluid communication between the reverse sleeve and the flowbore in response to a threshold pressure applied to the reverse sleeve. In some embodiments, after the completion of the gravel packing operation, a fluid (e.g., a reverse fluid) is pumped downhole via the communication path. Pressure from the reverse fluid shifts the reverse sleeve open, thereby allowing the reverse fluid to flow into the flowbore. As additional reverse fluid is pumped downhole through the communication path, excess reverse fluid disposes the diverter from the diverter seat and carries the diverter uphole and eventually to the surface, thereby removing the diverter from the flowbore. As such, the completion systems described herein are configured to reverse out the diverter, thereby eliminating a need to utilize a dissolvable diverter, or performing operations to drill out the diverter. In some embodiments, after completion of fracturing and gravel packing operations, certain unwanted fluids and solids (e.g., excess slurry, proppant, etc.) remain in the annular region or in the flowbore. In that regard, pumping the reverse fluid downhole through the communication path, through the reverse port, and uphole through the flowbore also removes the unwanted fluids and solids in a single operation. In some embodiments, a running tool that is initially deployed in the completion system is detached from the completion system to increase the flow rate of the reverse fluid uphole. In some embodiments, where the completion system extends through multiple zones, operations described in the paragraphs above and illustrated in at least FIGS. 3A-3E are performed one zone at a time, starting from the bottom zone.

In some embodiments, where the completion system extends through multiple zones, one or more of the diverter seats that are disposed in zones further uphole from the zone a diverter is disposed in are selectively activated at different times to allow diverters having identical size, approximately identical in size, or are within a threshold size range (e.g., 10%, 15%, 20% or a different range) to be deployed in the flowbore. In some embodiments, the completion system includes an activation line that runs through the completion system and is configured to selectively activate the diverter seats to deploy the activated diverter seats. In some embodiments, the diverter seats are selectively activated via acoustic signals. In some embodiments, the diverters are selectively activated after different threshold periods of time. In one or more of such embodiments, after a diverter is deployed in a zone and the fracture port is uncovered, a second diverter seat in an adjacent zone further uphole from the zone is activated to deploy the second diverter seat. The fracture port of the zone is then uncovered and a reverse fluid is pumped through the reverse port, into the flowbore to displace the diverter from the diverter seat, and transport the diverter uphole. Additional descriptions of selectively activating the diverter seats are provided in the paragraphs below. Additional descriptions of completion systems and methods to perform completion operations are provided in the paragraphs below and are illustrated in FIGS. 1-5.

Turning now to the figures, FIG. 1 is a schematic, side view of a completion environment 100 that includes a wellbore 114 having a completion system 120 deployed in the wellbore 114 to perform completion operations. As shown in FIG. 1, wellbore 114 extends from surface 108 of well 102 to or through formation 126. A hook 138, a cable 142, traveling block (not shown), and hoist (not shown) are provided to lower a tubular 116 of completion system 120 down wellbore 114 of well 102 or to lift tubular 116 up from wellhead 106 of well 102. In the embodiment of FIG. 1, tubular 116 extends across three zones 111A-111C of an annular region 125 that is defined by tubular 116 and wellbore 114. Completion system 120 includes isolation devices 110A-110D that are positioned along different sections of tubular 116 and are deployable to isolate each zone 111A, 111B, and 111C of annular region 125 during operations described herein. As referred to herein, an isolation device includes any device operable to isolate a section of a completion system 120 or annular region 125 from other sections of completion system 120 or annular region 125. Examples of isolation devices include, but are not limited to, packers, frac plugs, frac balls, sealing balls, sliding sleeves, bridge plugs, cement sleeves, wipers, pipe plugs, as well as other types of devices operable to isolate a section of the completion system 120 or annular region 125. Additional operations performed to deploy the isolation devices are provided in the paragraphs below. In some embodiments, completion system 120 includes additional isolation devices that are deployable to isolate additional zones that completion system 120 is deployed in.

At wellhead 106, an inlet conduit 122 is coupled to a fluid source 121 to provide fluids into well 102 and formation 126. In some embodiments, a perforation tool (not shown) is actuated to perforate formation 126. In one or more of such embodiments, propellants (not shown) deployed in each zone 111A, 111B, and 111C are detonated to form perforations and/or fractures 104A and 104A', 104B and 104B', and 104C and 104C', respectively. In one or more of such embodiments, perforations and/or fractures 104A and 104A', 104B and 104B', and 104C and 104C' are formed in formation 126 before completion system 120 is deployed in well 102. In one or more of such embodiments, perforations and/or fractures 104A and 104A', 104B and 104B', and 104C and 104C' are formed one zone at a time.

In the embodiment of FIG. 1, fluids are circulated into well 102 through tubular 116 and a communication path (shown in FIG. 2) back toward surface 108. Moreover, completion system 120 is also operable to circulate fluids in a reverse direction, where the reverse fluids flow downhole into well 102 through the communication path and back uphole to surface 108 through a flowbore 117 of tubular 116. To that end, a diverter or an outlet conduit 128 may be connected to a container 130 at the wellhead 106 to provide a fluid return flow path from wellbore 114. In the embodiment of FIG. 1, operations described herein are monitored by controller 118 at surface 108. Although FIG. 1 illustrates controller 118 as a surface-based device, in some embodiments, one or more components of controller 118 are located downhole. Further, in some embodiments, controller 118 is located at a remote location. Further, in some embodiments, controller 118 is a component of the completion system 120. In some embodiments, controller 118 provides the status of one or more operations performed during well operations described herein for display. In one or more of such embodiments, an operator having access to controller 118 operates controller 118 to monitor the status of one or more operations described herein, and in some cases, to make adjustments to one or more operations described herein. In some embodiments, controller 118 dynamically monitors, analyzes, and adjusts one or more well operations described herein.

Although FIG. 1 illustrates a cased wellbore, the completion system 120 illustrated in FIG. 1, as well as other completion systems described herein, are deployable in open-hole wellbores, cased wellbores of offshore wells, and open-hole wellbores of offshore wells. Further, although FIG. 1 illustrates a completion system 120 having four isolation devices that form three zones, completion system 120 may include a different number of isolation devices that form a different number of zones. In some embodiments, completion system 120 is a single zone completion system and is deployed in one zone. Additional descriptions and illustrations of completion system 120 and components of completion system 120 are provided in the paragraphs below and are illustrated in at least FIGS. 2, 3A-3E, and 4. Further, additional descriptions and illustrations of methods to perform completion operations are provided in the paragraphs below and are illustrated in at least FIGS. 5 and 6.

Figure 2:
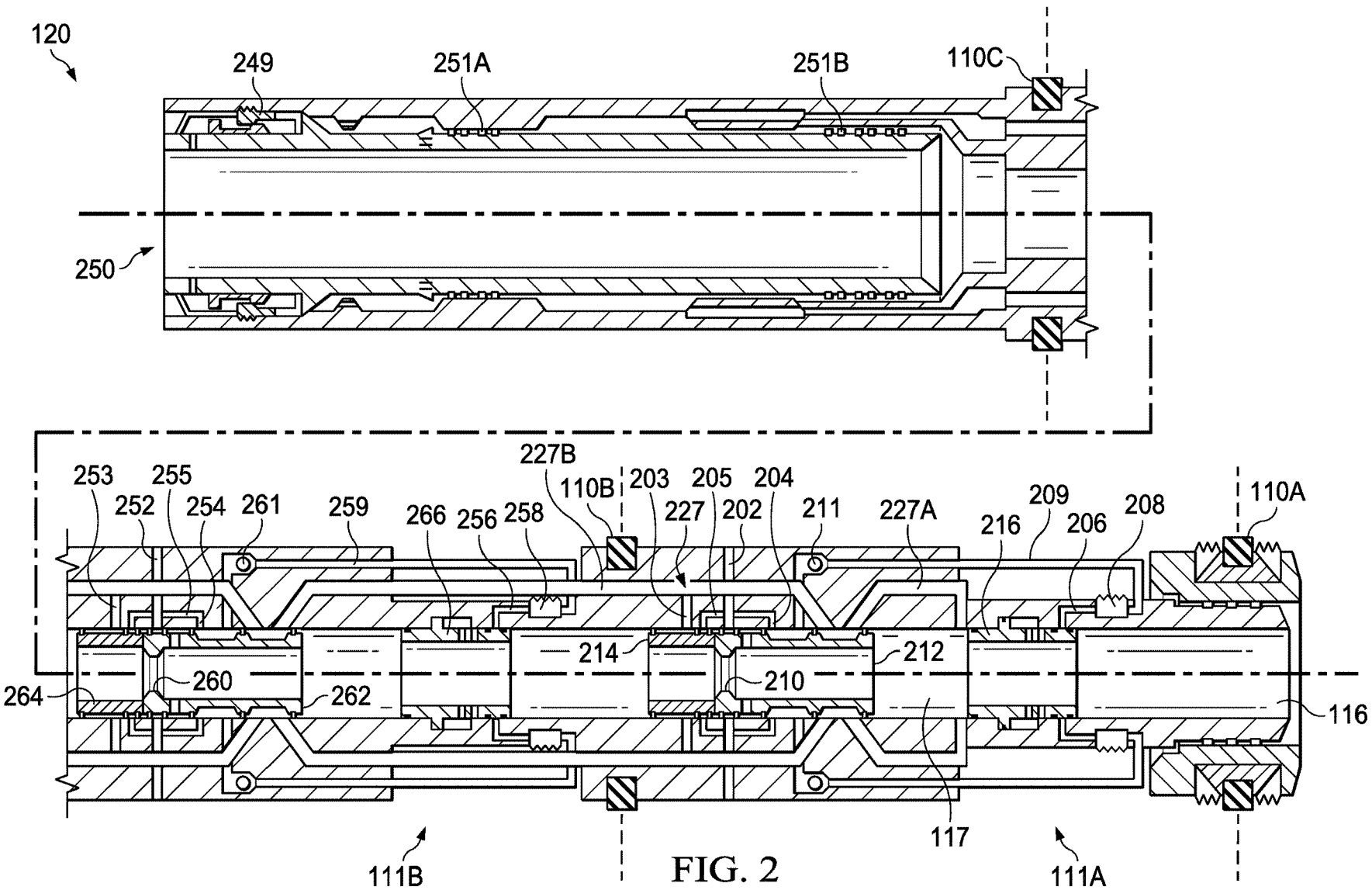
FIG. 2 is a cross-sectional, zoomed-in view of the completion system of FIG. 1.
Figure 2:
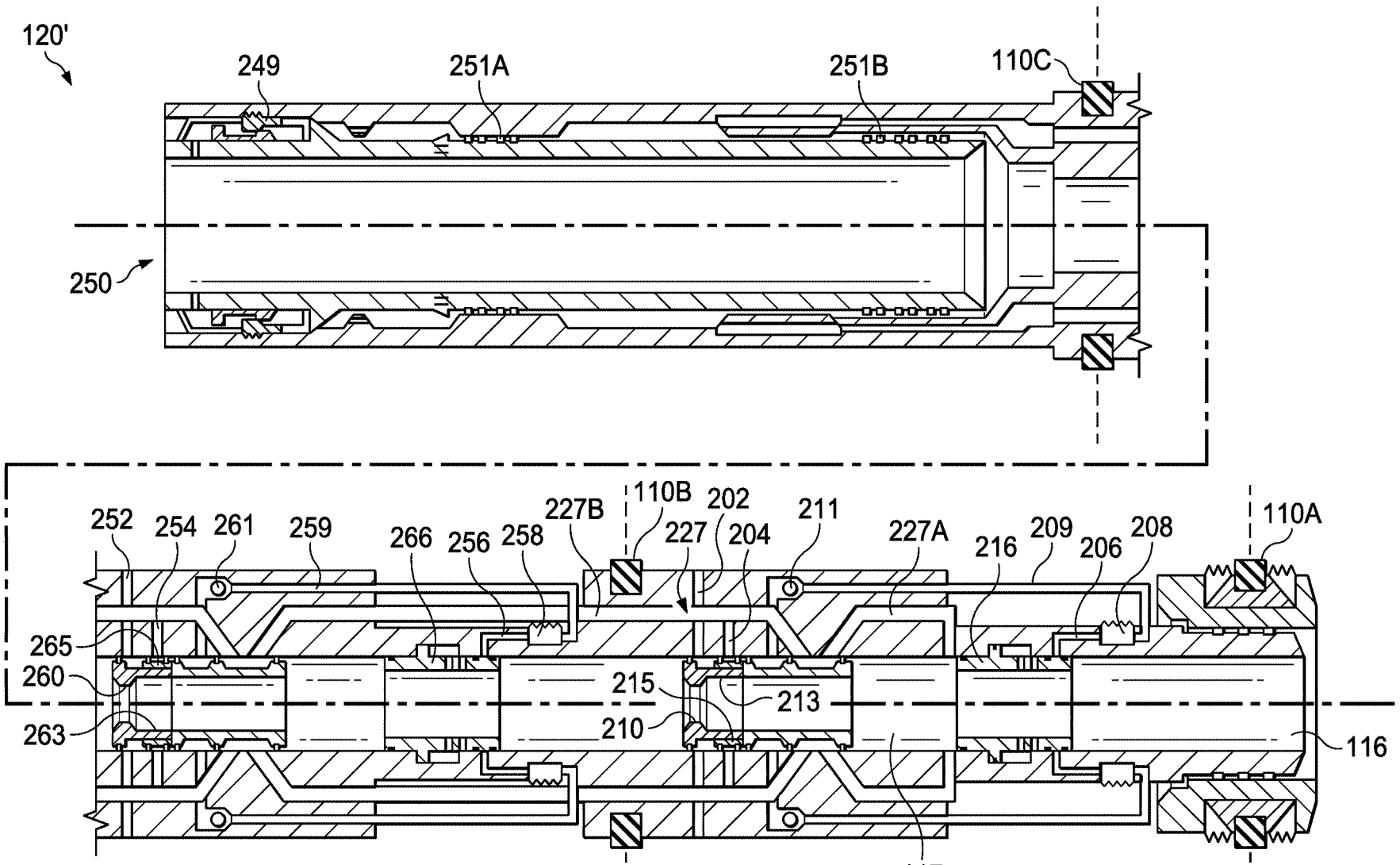

FIG. 2 is a cross-sectional, zoomed-in view of completion system 120 of FIG. 1. In the embodiment of FIG. 2, completion system 120 is deployed across two zones 111A and 111B. Completion system 120 includes isolation devices 110A, 110B, and 110C, which are disposed in zones 111A and 111B of annular region 125, and are deployable (e.g., via pressure, timer, etc.) to isolate zones 111A and 111B. Additional descriptions of operations performed to deploy isolation devices 110A, 110B, and 110C are described in the paragraphs herein. A portion of completion system 120 deployed in zone 111A includes a first port (fracture port) 202 that is configured to provide fluid communication from flowbore 117 to a portion of annular region 125 of FIG. 1 that is within zone 111A. A diverter seat 210 is disposed in flowbore 117. Examples of diverter seats include, but are not limited to, ball seats, dart seats, and plug seats that are configured to catch balls, darts, and plugs, respectively. In the embodiment of FIG. 2, diverter seat 210 is a ball seat that is configured to temporarily catch a ball that flows downhole through flowbore 117. In the embodiment of FIG. 2, diverter seat 210 is disposed further uphole from first port 202. In some embodiments, diverter seat 210 is parallel or is disposed further downhole from first port 202. Completion system 120 also includes a cover 212 that is disposed in the wall of tubular 116 and configured to initially cover first port 202 to prevent fluid communication through first port 202. In some embodiments, cover 212 is a sleeve that is configured to shift from a first position illustrated in FIG. 2 to a second position to uncover first port 202. In the embodiment of FIG. 2, a force generated by diverter seat 210 catching a diverter shifts cover 212 from an initial position that covers first port 202 to a second position that uncovers first port 202, thereby allowing fluid communication between flowbore 117 and a communication path 227 through first port 202. In the embodiment of FIG. 2, communication path 227 extends across zones 111A and 111B, and further uphole to or near the surface to provide a fluid flow path for fluids to flow uphole or downhole during different operations described herein. In the embodiment of FIG. 2, the portions of communication path 227 that extend through zone 111A include a first portion 227A and a second portion 227B. In some embodiments, portions of communication path 227 are formed from one or more tubes that straddle one or more filters of completion system 120. In some embodiments, portions of communication path 227 are formed from one or more concentric pipes. In some embodiments, portions of communication path 227 are formed from a plurality of machined flow paths through one or more sleeves of completion system 120. Additional descriptions of cover 212 and configurations of cover 212 are provided in the paragraphs below and are illustrated in at least FIGS. 3A-3C.

Completion system 120 also includes a second port (reverse port) 204 that is positioned further downhole from first port 202 and configured to provide fluid communication between communication path 227 and flowbore 117. In the embodiment of FIG. 2, connectors 203 and 205 fluidly connect communication path 227 and second port 204. In the embodiment of FIG. 2', second port 204 is directly connected to communication path 227. In some embodiments, a different number and shaped connectors (not shown) fluidly connect communication path 227 and second port 204. A cover 214 is initially disposed over second port 204 to prevent fluid communication during a fracturing operation. In the embodiment of FIG. 2, cover 214 is a sleeve that is initially configured to prevent fluid communication through second port 204 while cover 214 is in a first position, and is configured to permit fluid communication from communication path 227, through connectors 203 and 205, and to second port 204 after cover 214 is shifted to a second position. Additional descriptions of cover 214 and configurations of cover 214 are provided in the paragraphs below and are illustrated in at least FIGS. 3C and 3D.

Completion system 120 also includes a port 206 positioned further downhole from second port 204, and a cover 216 that is initially disposed over port 206 to prevent fluid communication from port 206 to flowbore 117. In the embodiment of FIG. 2, port 206 is a production port that provides fluid communication between annular region 125 and flowbore 117 during a hydrocarbon production operation. In some embodiments, cover 216 remains in the position illustrated in FIG. 2 to prevent fluid communication from port 206 to flowbore 117 until commencement of the hydrocarbon production operation. In some embodiments, cover 216 remains in the position illustrated in FIG. 2 until completion operations described herein are completed for each zone that completion system extends through. At or shortly prior to commencement of the hydrocarbon production operation, cover 216 is shifted to a second position (e.g., electrically, mechanically, or hydraulically and via pressure, sensor, or timer) to uncover port 206 and to establish fluid communication between port 206 and flowbore 117.

Completion system 120 also includes a second tubular 209 that is configured to provide fluid communication from zone 111A of the annular region to communication path 227. In the embodiment of FIG. 2, second tubular 209 includes a flow restrictor 211 that is fluidly connected to second tubular 209 and is configured to permit fluid flow in one direction (e.g., in a direction from the annular region into communication path 227), and inhibit fluid flow in a second and opposite direction (e.g., in a direction from communication path 227 out to the annular region). In some embodiments, second tubular 209 is a dehydration tube. Completion system 120 also includes a filter 208 (e.g., a screen) that is configured to filter solid particles (e.g., sand) that are greater than a threshold size from flowing into completion system 120. In the embodiment of FIG. 2, a fluid that flows into completion system 120 first flows through filter 208 before the fluid flows into port 206 or into second tubular 209. Additional descriptions of components of completion system 120 in zone 111A are provided in the paragraphs below.

Completion system 120 also includes a running tool 250 having a latch 249 that is configured to couple or decouple running tool 250 to completion system 120 during different operations described herein. In the embodiment of FIG. 2, latch 249 is in a position that couples running tool 250 to completion system 120. Running tool 250 also includes seals 251A and 251B that are configured to seal off portions of completion system 120 downhole from seals 251A and 251B during different operations described herein. In the embodiment of FIG. 2, and while running tool 250 and seals 251A and 251B are in the positions illustrated in FIG. 2, a threshold pressure to be applied through flowbore 117 and communication path 227 to set isolation devices 110B and 110C, thereby isolating zones 111A and 111B of annular region 125 as shown in FIG. 1.

In the embodiment of FIG. 2, a portion of completion system 120 that extends into adjacent zone 111B includes a first port 252, a second port 254, connectors 253 and 255, a port 256, a filter 258, a third tubular 259, a restrictor 261, a cover 262, a cover 264, and a cover 266. First port 252, second port 254, connectors 253 and 255, port 256, filter 258, third tubular 259, restrictor 261, cover 262, cover 264, and cover 266 are similar or identical to first port 202, second port 204, connectors 203 and 205, port 206, filter 208, second tubular 209, restrictor 211, cover 212, cover 214, and cover 216, which are described herein.

FIG. 2' is a cross-sectional, zoomed-in view of a completion system 120' similar to completion system 120 of FIG. 2. Completion system 120' includes tubular 116, flowbore 117, isolation devices 110A-110C, first port 202, second port 204, port 206, filter 208, second tubular 209, restrictor 211, cover 216, first port 252, second port 254, port 256, filter 258, third tubular 259, restrictor 261, and cover 266 are similar or identical to includes tubular 116, flowbore 117, isolation devices 110A-110C, first port 202, second port 204, port 206, filter 208, second tubular 209, restrictor 211, cover 216, first port 252, second port 254, port 256, filter 258, third tubular 259, restrictor 261, cover 266, running tool 250, latch 249, and seals 251A and 251B of completion system 120, which are described herein. As such, the above detailed descriptions and illustrations of the foregoing components of completion system 120 are not replicated to describe and illustrate corresponding components of completion system 120' for the sake of brevity.

In the embodiment of FIG. 2' second ports 204 and 254 are directly connected to communication path 227. Completion system 120' also includes covers 213, 215, 263, and 265 that are disposed in flowbore 117. Covers 213 and 263, similar to covers 212 and 262 of system 120 of FIG. 2, respectively, are configured to shift to permit fluid communication through first ports 202 and 252, respectively. Further, covers 215 and 265, similar to covers 214 and 264 of completion system 120 of FIG. 2, respectively, are configured to shift to permit fluid communication through second ports 204 and 254, respectively. Additional descriptions of cover 214 and configurations of cover 214 are provided in the paragraphs below and are illustrated in at least FIGS. 3C' and 3D'. Although FIGS. 2 and 2' illustrate two different embodiments of covers that are shiftable to permit fluid communication through first ports 202 and 252 and second ports 204 and 254, in some embodiments, completion systems 120 and 120' utilize other covers having different shapes and configurations to prevent or permit fluid flow through first ports 202 and 252 and second ports 204 and 254 during different operations described herein.

Figure 3A:
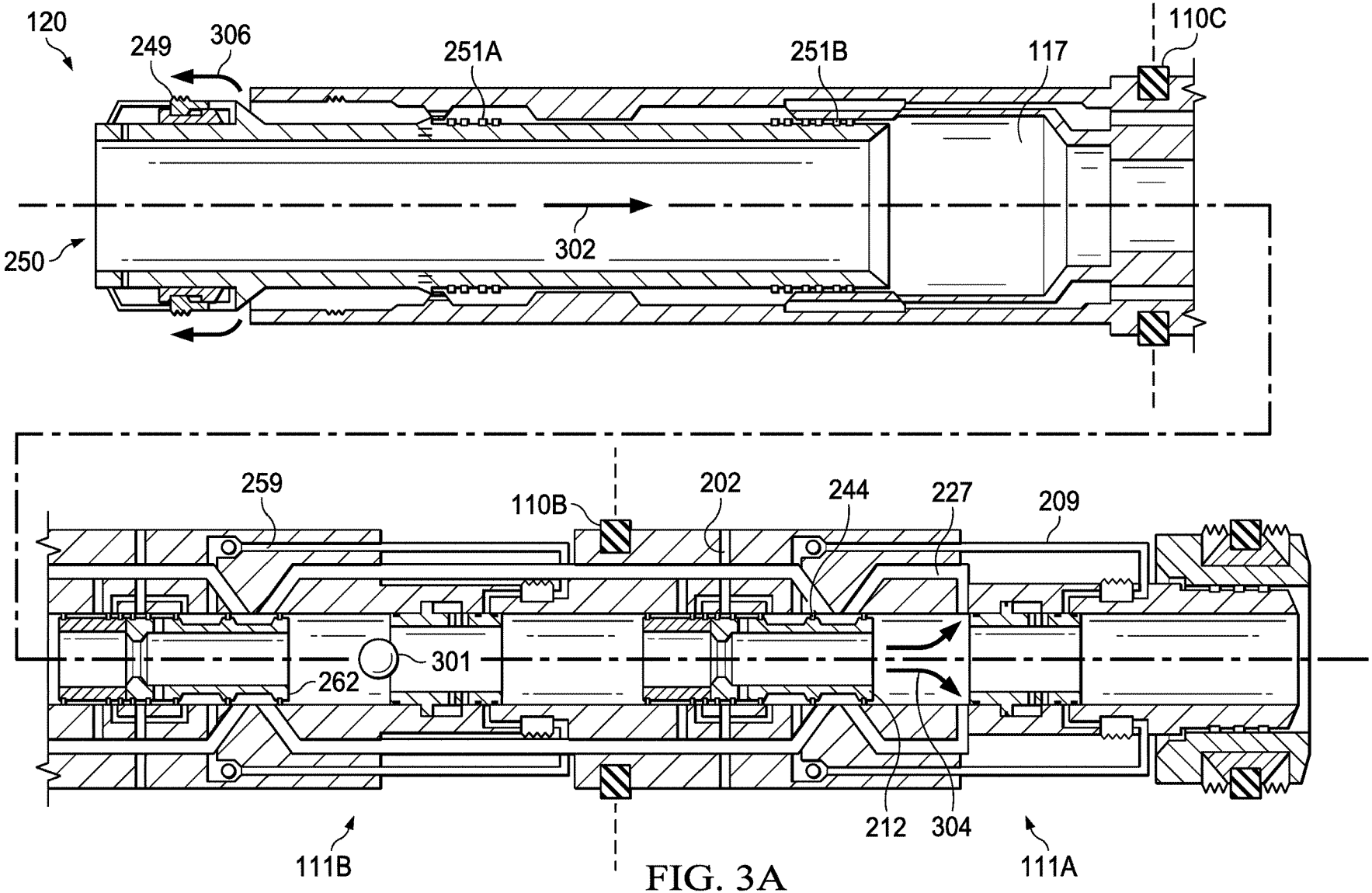
FIG. 3A illustrates a cross-sectional view of the completion system of FIG. 2, where a ball flows downhole in a flowbore of the completion system.

FIG. 3A illustrates a cross-sectional view of the completion system of FIG. 2, where a ball 301 flows downhole in flowbore 117 of completion system 120. In the embodiment of FIG. 3A, after a threshold pressure is applied through flowbore 117 and communication path 227 to set isolation devices 110B and 110C to isolate zones 111A and 111B of annular region 125 as shown in FIG. 1, latch 249 is shifted from the position illustrated in FIG. 2 to the position illustrated in FIG. 3A to decouple running tool 250 from completion system 120. Further, a fluid carrying ball 301 flows downhole through flowbore 117 as indicated by arrow 302, into communication path 227 as indicated by arrow 304, and uphole through communication path 227 towards the surface as indicated by arrow 306. In the embodiment of FIG. 3A, cover 212 prevents fluid communication from flowbore 117 into first port 202. Further, a portion of cover 212 is disposed at location 244, thereby preventing fluid communication between communication path 227 and second tubular 209.

Figure 3B:
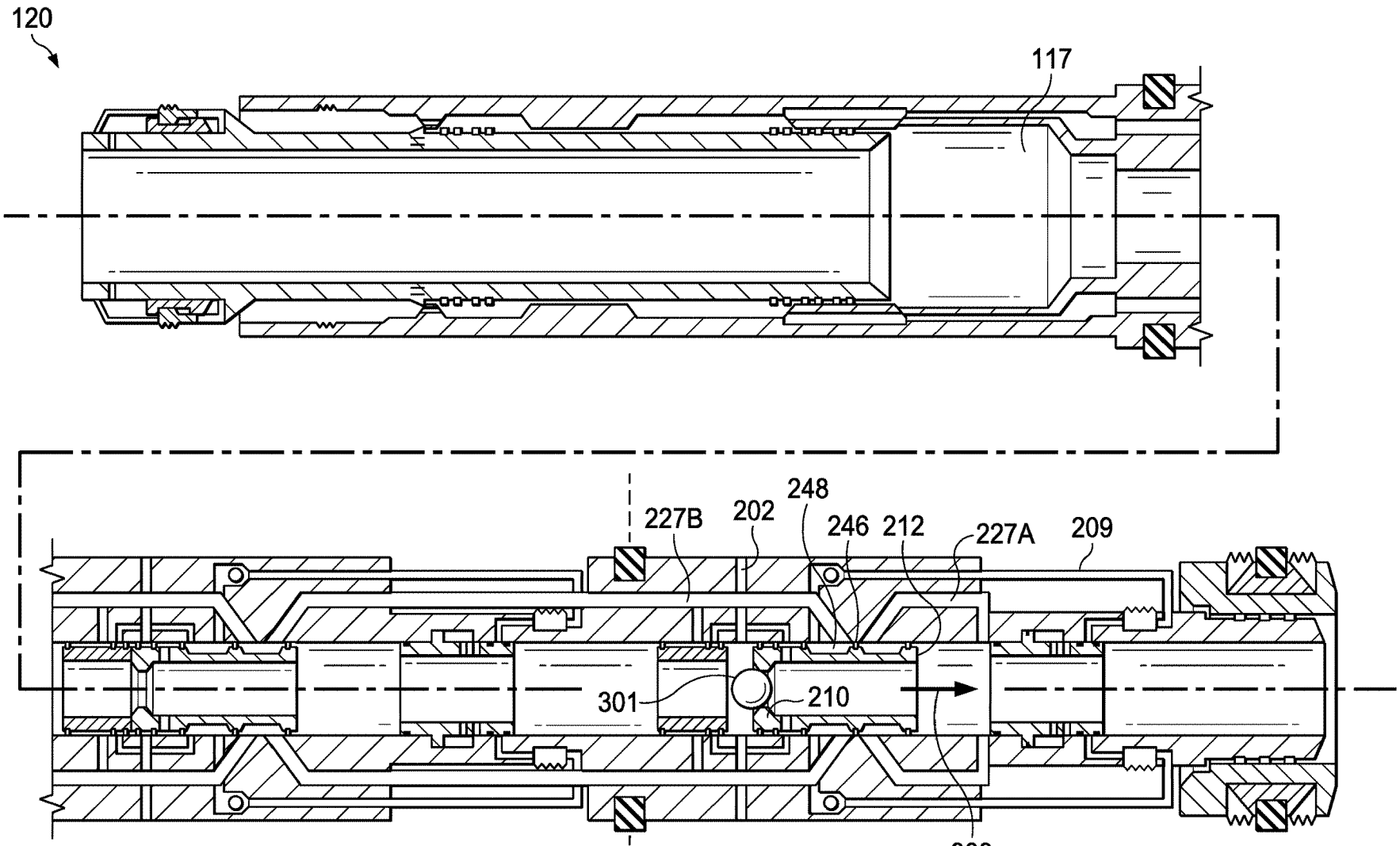
FIG. 3B illustrates the cross-sectional view of the completion system of FIG. 3A after the ball lands on a diverter seat disposed in the flowbore of the completion system.

Ball 301 eventually lands on diverter seat 210 as shown in FIG. 3B. In that regard, FIG. 3B illustrates the cross-sectional view of completion system 120 of FIG. 3A after ball 301 lands on diverter seat 210 of completion system 120. In the embodiment of FIG. 3B, the force generated from pressure applied uphole of ball 301 on diverter seat 210 shifts cover 212 in a downhole direction as indicated by arrow 308 from the position illustrated in FIG. 3A to the position illustrated in FIG. 3B. As illustrated in FIG. 3B, cover 212 no longer prevents fluid communication between flowbore 117 and first port 202. Further, a portion of cover 212 has shifted to a location 246 that cuts off fluid communication between a first portion 227A of communication path 227 from an adjacent second portion 227B of communication path 227 that is uphole from first portion 227A of communication path 227, thereby preventing further fluid flow into first portion 227A and any other portion of communication path 227 that is further downhole (not shown) from (e.g., below) first portion 227A. Further, fluid communication between second tubular 209 and communication path 227 is established at location 248 after cover 212 shifts from location 244 as shown in FIG. 3A to location 246 in FIG. 3B. In some embodiments, where completion system 120 includes a flow path that is configured to provide fluid communication from zone 111A of the annular region to communication path 227, cover 212 shifts from the position illustrated in FIG. 3A to the position illustrated in FIG. 3B to provide fluid communication between the flow path and communication path 227.

Figure 3C:
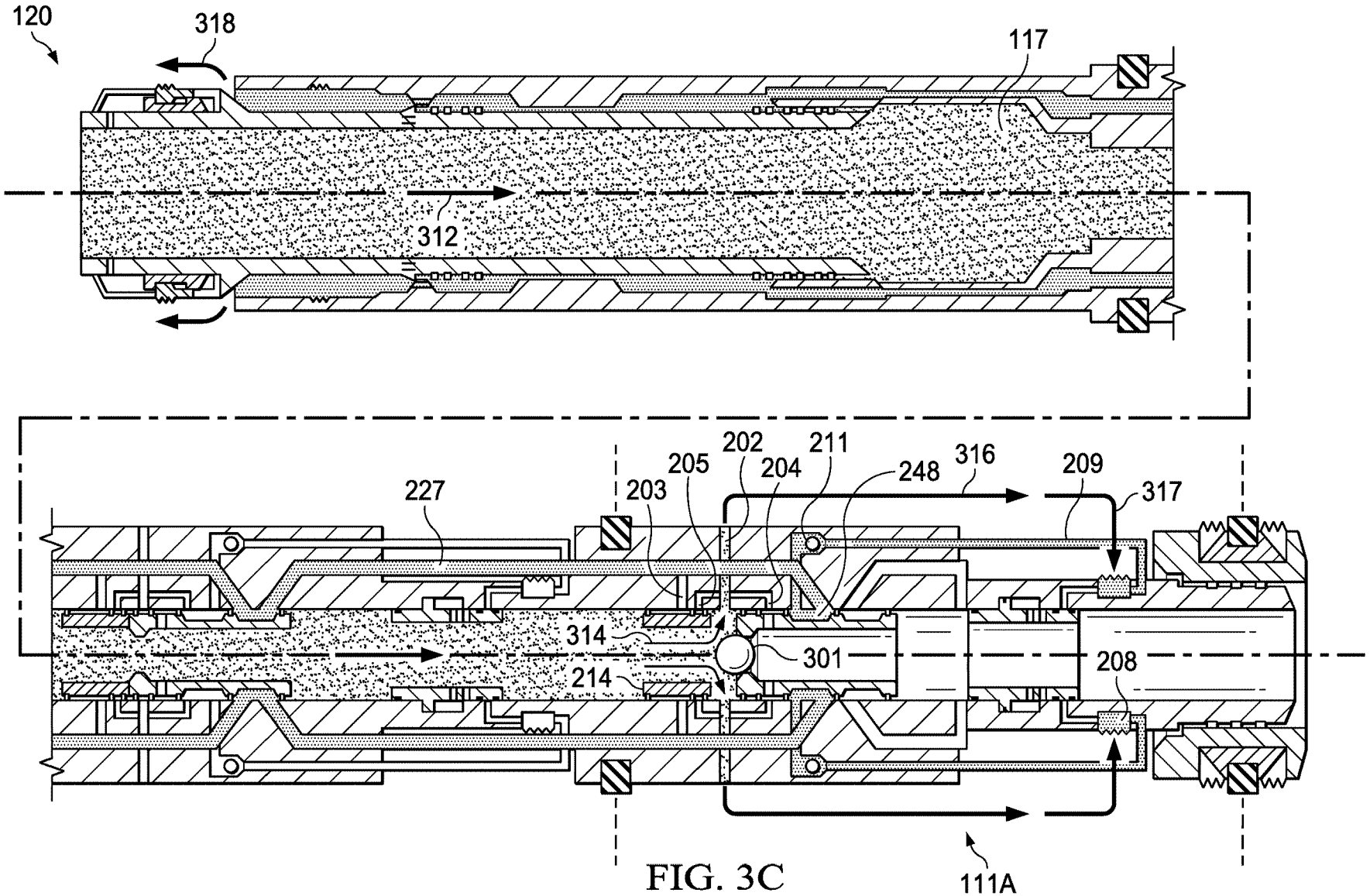
FIG. 3C illustrates an operation where a fluid is circulated through the completion system of FIG. 3A after a cover that covers a first port is shifted to provide fluid communication from the flowbore to a zone of the annular region.
Figure 3C:
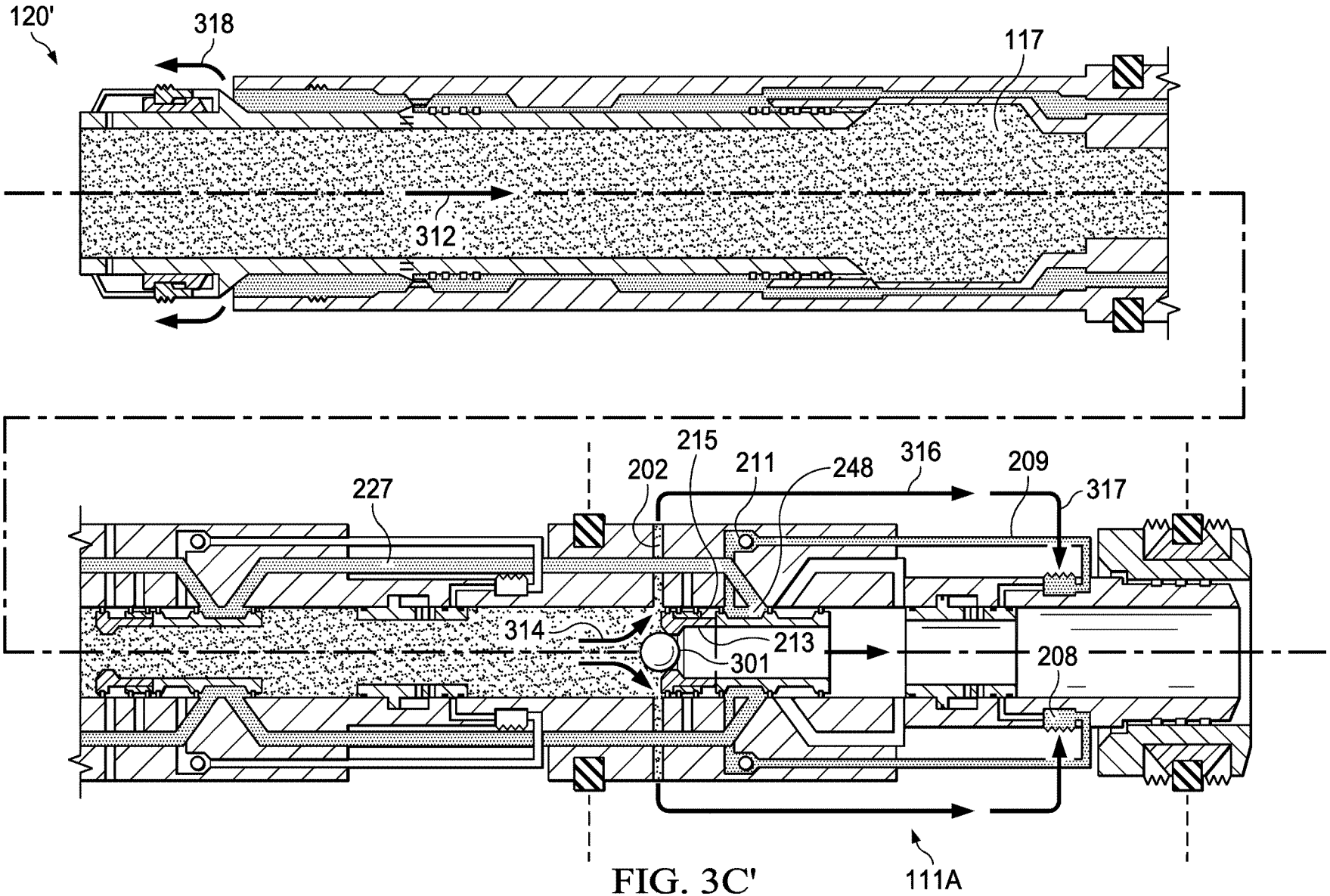

After fluid communication between flowbore 117 and first port 202 is established, fluids are pumped downhole during certain operations (e.g., fracturing and gravel packing operations). In that regard, FIG. 3C illustrates an operation where a fluid is circulated through completion system 120 of FIG. 3A after cover 212 is shifted to provide fluid communication from flowbore 117 to zone 111A of the annular region. More particularly, FIG. 3C illustrates a slurry containing a mixture of fluid and solid particles flowing downhole through flowbore 117 as indicated by arrow 312. The slurry flows from flowbore 117 into first port 202 as indicated by arrow 314, and out of first port 202 and into zone 111A of the annular region as indicated by arrow 316. The slurry then flows from zone 111A through filter 208 as indicated by arrow 317, where solid particles greater than a threshold size are filtered by filter 208 from flowing into completion system 120. The filtered fluid flows through second tubular 209 and from second tubular 209 to communication path 227 at location 248. After flowing into communication path 227, the filtered fluid continues to flow through communication path 227 uphole towards the surface as indicated by arrow 318. In the embodiment of FIG. 3C, second tubular 209 is a dehydration tube configured to remove excess fluids in zone 111A during and after gravel packing operations. In some embodiments, other types of fluids/slurries are circulated through completion system 120 during one or more operations described herein.

Figure 3D:
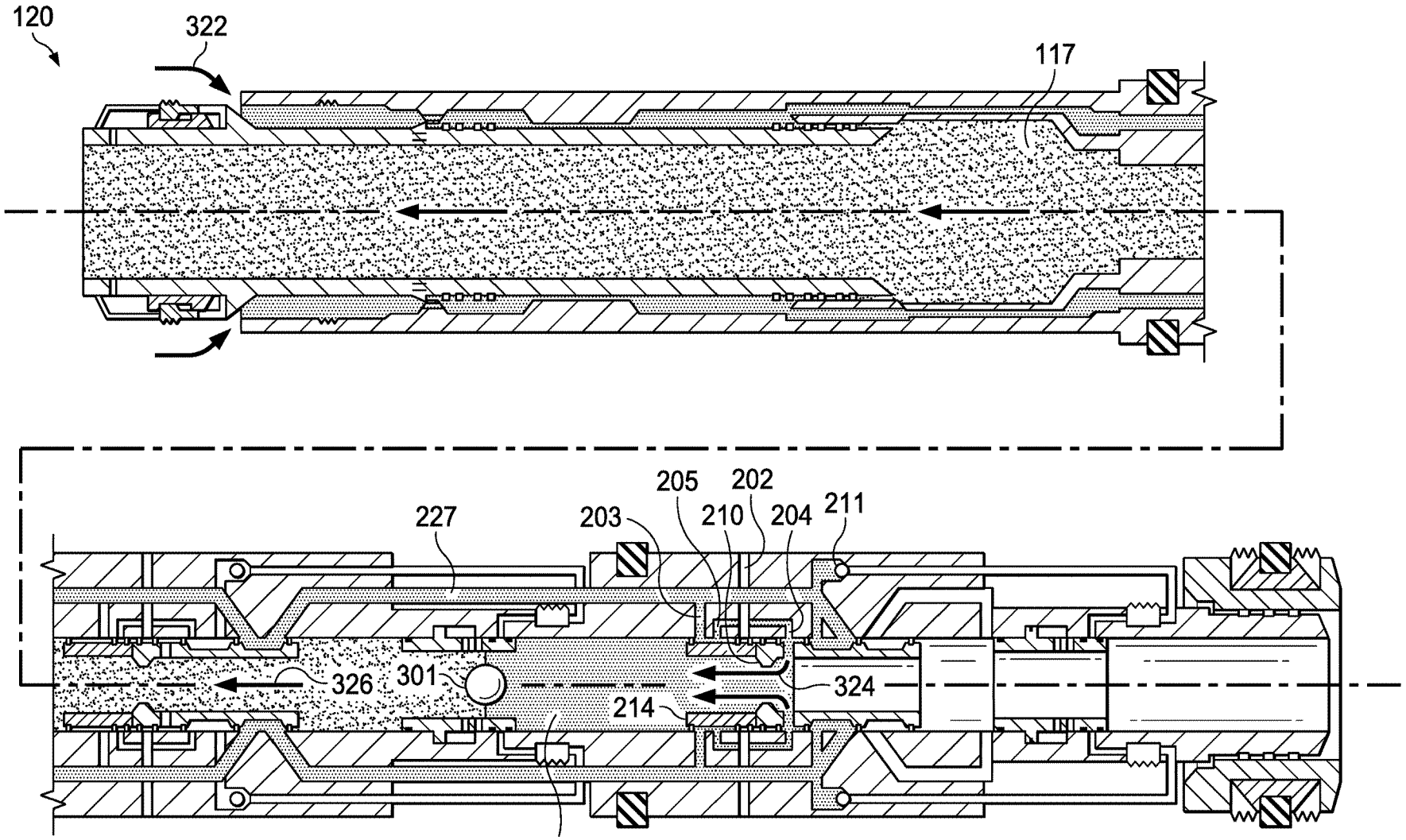
FIG. 3D illustrates an operation where a reverse fluid flowing out of a second port dislodges the ball from the diverter seat and carries the ball uphole after a cover that covers the second port is shifted to provide fluid communication through the second port.
Figure 3D:
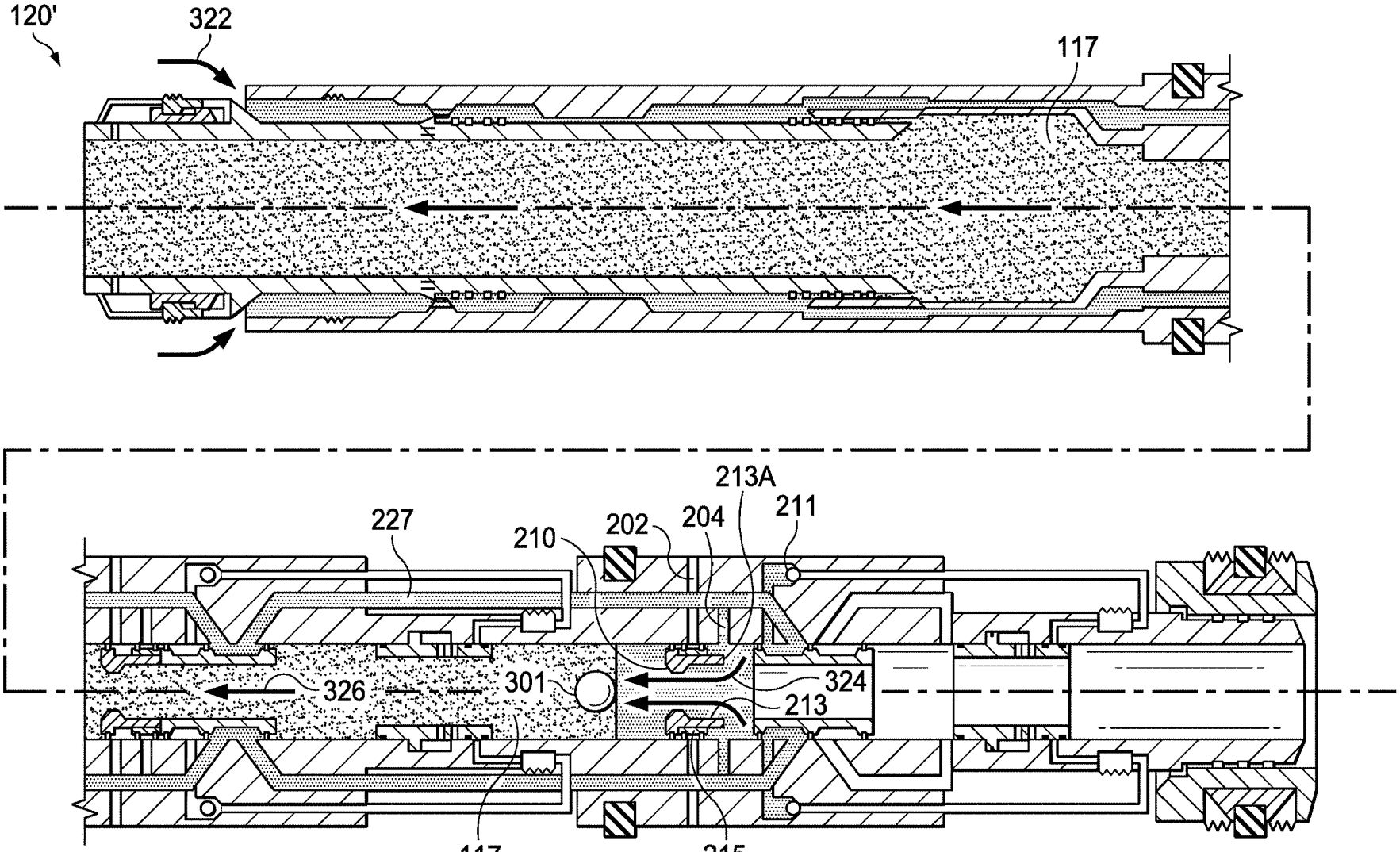

After certain operations (e.g., fracturing and gravel packing) are completed, ball 301 is removed from flowbore 117. In some embodiments, cover 214, which initially prevents fluid communication between flowbore 117 and second port 204 of FIG. 2 is shifted to a second position establish fluid communication from second port 204 to flowbore 117. In some embodiments, cover 214 is shifted electrically, mechanically, or hydraulically and via pressure, sensor, or timer. FIG. 3D illustrates an operation where a reverse fluid flowing out of second port 204 dislodges ball 301 from diverter seat 210 and carries ball 301 uphole after cover 214 is shifted to provide fluid communication through second port 204. In the embodiment of FIG. 3D, the reverse fluid is pumped downhole through communication path 227 as indicated by arrow 322. Pressure applied by the reverse fluid shifts cover 214 from the position illustrated in FIG. 3C to the second position illustrated in FIG. 3D. In the embodiment of FIG. 3D, movement of cover 214 provides fluid communication from connector 203 to connector 205, which was previously prevented by cover 214 as shown in FIG. 3C before movement of cover 214, thereby establishing fluid communication between communication path 227 and flowbore 117 through second port 204. In the embodiment of FIGS. 3C-3D, movement of cover 214 from the position illustrated in FIG. 3C (which does not cover first port 202) to the position illustrated in FIG. 3D also covers first port 202. After fluid communication is established between communication path 227 and flowbore 117, the reverse fluid flows into flowbore 117 as indicated by arrow 324 uphole. Pressure from the reverse fluid dislodges ball 301 from diverter seat 210 and carries ball 301 uphole towards the surface as indicated by arrow 326. Further, circulating the reverse fluid also removes other fluids and undesired solid particles that remain in completion system 120, thereby removing ball 301 and undesired fluids and solid particles in a single operation.

Although FIG. 3D illustrates cover 214 shifting in an downhole direction to establish fluid communication through second port 204, in some embodiments, cover 214 is configured to shift in an uphole direction from an original position to a second position to establish fluid communication through second port 204. Similarly, in some embodiments, cover 214 is configured to shift in an uphole direction from an original position to a second position to cover port 202.

In that regard, FIG. 3C'-3D' illustrate movement of cover 215 of completion system 120' of FIG. 2' from a position illustrated in FIG. 3C' to a position illustrated in FIG. 3D' to provide fluid communication from communication path 227 through second port 204 to flowbore 117. In the embodiment of FIGS. 3C'-3D', pressure applied by the reverse fluid shifts cover 215 from the position illustrated in FIG. 3C' in an uphole direction to the second position illustrated in FIG. 3D'. Further, the pressure also shifts a first piece 213A of cover 213 from the position illustrated in FIG. 3C' in an uphole direction to the second position illustrated in FIG. 3D', thereby uncovering second port 204, and covering first port 202. Although FIGS. 3C'-3D' illustrate shifting cover 215 and first piece 213A of cover 213 in an uphole direction, in some embodiments, pressure, or another activation mechanism shifts cover 215 and first piece 213A of cover 213 in a downhole direction, or a different direction or orientation to establish fluid communication through second port 204 and to cover first port 202, respectively.

Figure 3E:
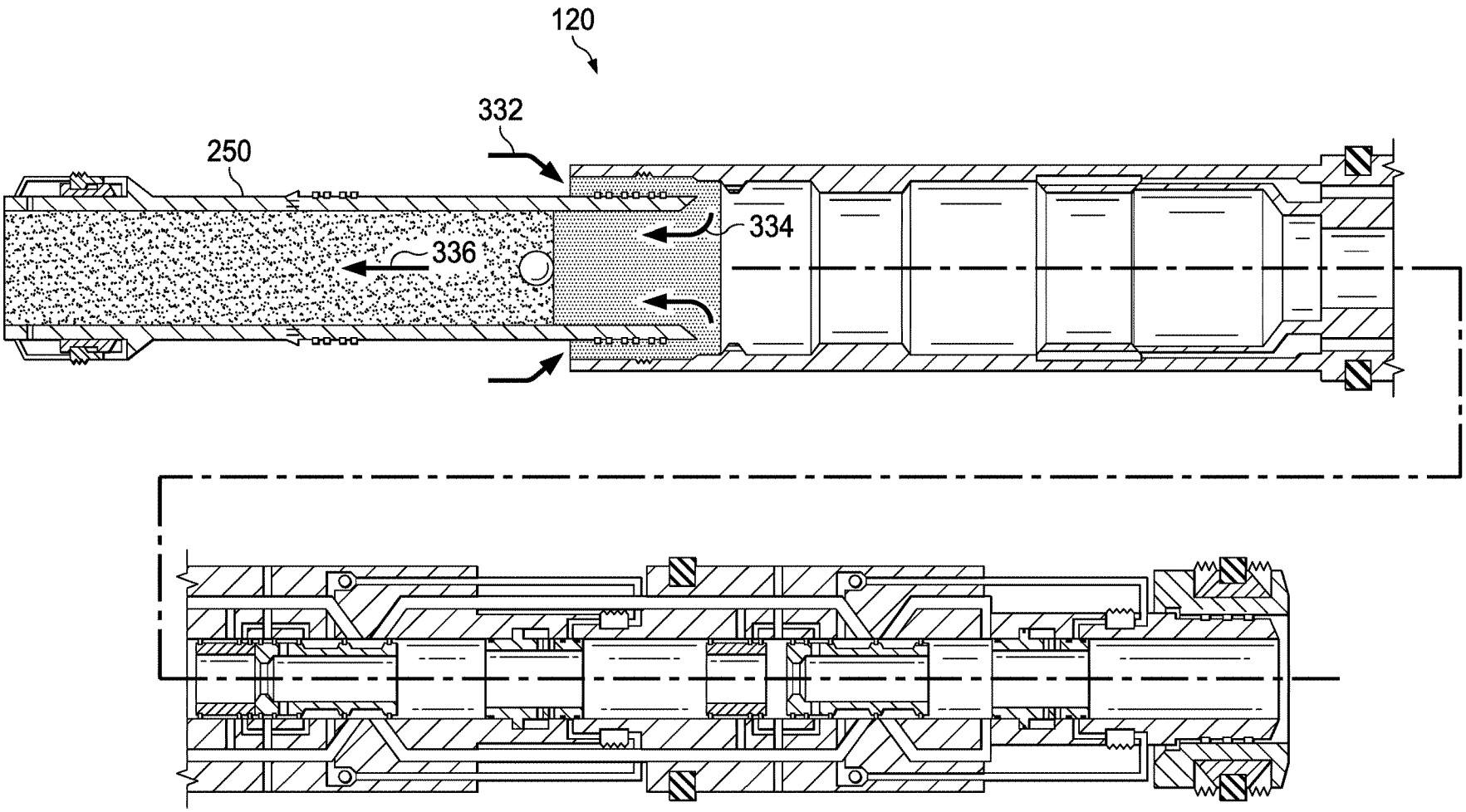
FIG. 3E illustrates an operation where a running tool is dislodged from the completion system to increase the flow rate of the reverse fluid through the flowbore.

In some embodiments, the flow rate of the reverse fluid through flowbore 117 is increased. In that regard, FIG. 3E illustrates an operation where a running tool 350 is dislodged from completion system 120 to increase the flow rate of the reverse fluid through flowbore 117. In the embodiment of FIG. 3E, after running tool 350 is dislodged and moved further uphole, reverse fluid flows into flowbore 117 as indicated by arrows 332, 334, and 336, at a faster rate, thereby expediting the reverse out process.

In some embodiments, after performing the operations described above and illustrated in FIGS. 3A-3E, identical or similar operations are performed at zone 111B of FIG. 2. In some embodiments, where completion system 120 extends through additional zones, the operations described above and illustrated in FIGS. 3A-3E are performed one zone at a time, starting from the bottom zone, and ending with the top zone of the multiple zones.

Figure 4:
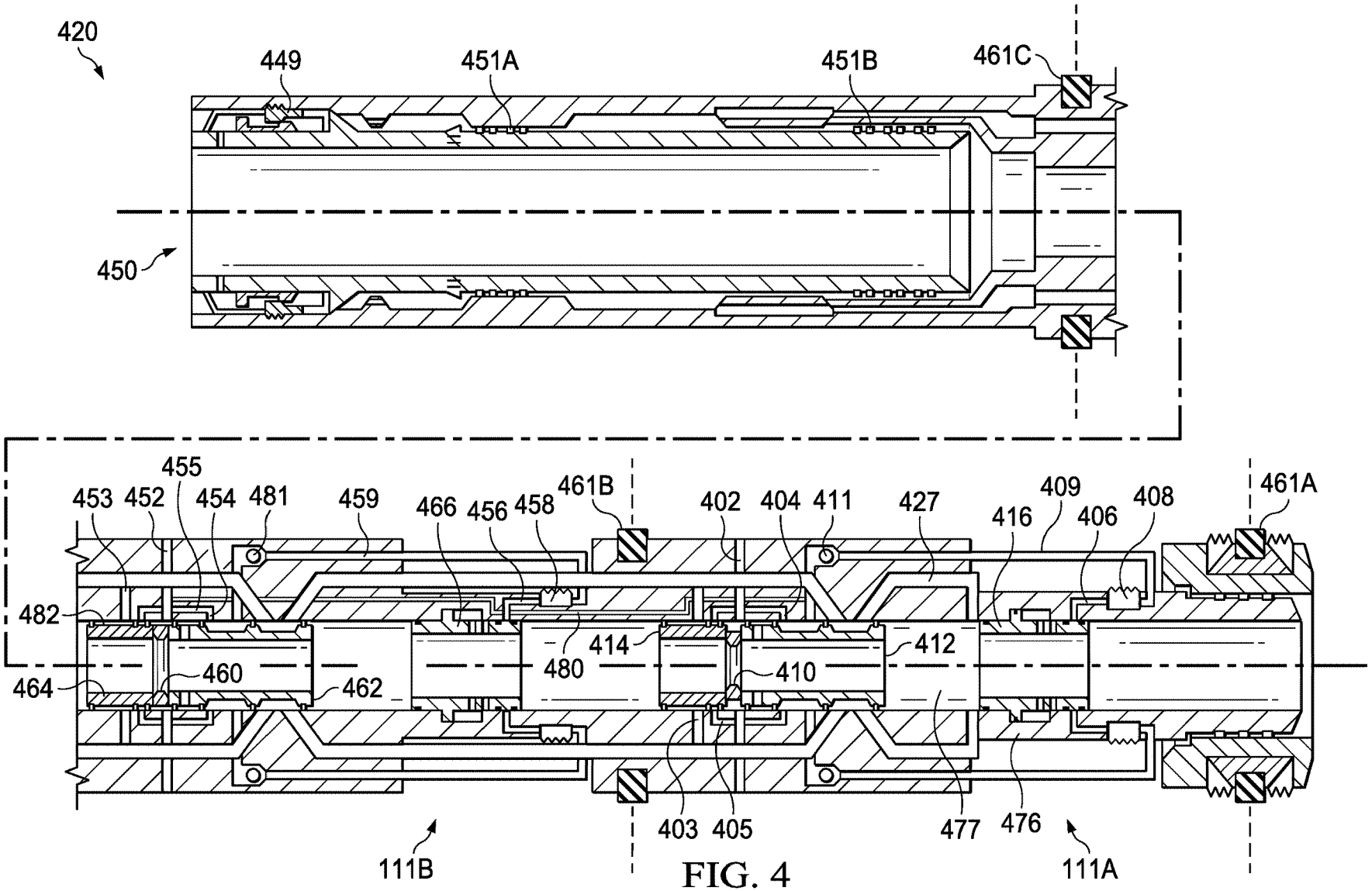
FIG. 4 is a cross-sectional, zoomed-in view of another completion system similar to the completion system of FIG. 2.

FIG. 4 is a cross-sectional, zoomed-in view of another completion system 420 similar to completion system 120 of FIG. 2. In the embodiment of FIG. 4, completion system 420 includes a tubular 476 that is deployed across zones 111A and 111B of annular region 125 of FIG. 1. A flowbore 477, similar to flowbore 117 of FIG. 2, is formed from interior walls of tubular 116 and also extends through zones 111A and 111B.

Completion system 420 includes first ports 402 and 452, second ports 404 and 454, connectors 403, 405, 453, and 455, ports 406 and 456, filters 408 and 458, second tubular 409, third tubular 459, flow restrictors 411 and 481, covers 412 and 462, covers 414 and 464, covers 416 and 466, running tool 450, latch 449, and seals 451A and 451B that are similar or identical to first ports 202 and 252, second ports 204 and 254, connectors 203, 205, 253, 255, ports 206 and 256, filters 208 and 258, second tubular 209, third tubular 259, flow restrictors 211 and 261, covers 212 and 262, covers 214 and 264, covers 216 and 266, running tool 250, latch 249, and seals 251A and 251B of completion system 120 of FIG. 2, respectively, which are described in the paragraphs herein. Further, completion system 420 also includes tubular 476, flowbore 477, and isolation devices 461A, 461B, and 461C, that are similar or identical to tubular 116, flowbore 117, and isolation devices 110A-110C of completion system 120 of FIG. 2, respectively, which are described in the paragraphs herein. Further, the foregoing components of completion system 420 are also deployable to perform similar or identical operations described above and illustrated in FIGS. 3A-3E. As such, the above detailed descriptions and illustrations of the foregoing components of completion system 120 are not replicated to describe and illustrate corresponding components of completion system 420 for the sake of brevity.

Completion system 420 includes a first diverter seat 410 and a second diverter seat 460 that are both disposed in flowbore 477. In the embodiment of FIG. 4, first diverter seat 410 is deployed in the bottom zone (zone 111A) of completion system 420, whereas second diverter seat 460 is deployed in an adjacent zone (zone 111B) uphole from the bottom zone. In the embodiment of FIG. 4, first diverter seat 410 is already actuated to catch diverters, such as balls that flow downhole through flowbore 477, whereas second diverter seat 460 and other diverter seats (not shown) that are further uphole are not initially activated to allow approximately identical sized diverters or diverters within a size range to flow through multiple diverter seats that are further uphole and to reverse out through the multiple diverter seats. In the embodiment of FIG. 4, completion system 420 includes an activation line 480 that is disposed (or partially disposed) in tubular 476 and configured to activate second diverter seat 460 in response to a threshold amount of pressure applied through activation line 480. More particularly, activation line 480 is configured to apply the threshold amount of pressure through activation port 482 to activate second diverter seat 460. In the embodiment of FIG. 4, first diverter seat 410 is deployed in the bottom zone and is pre-activated. In some embodiments, where completion system 420 includes additional diverter seats (not shown) deployed further uphole from second diverter seat 460, the additional diverter seats are also configured to activate in response to a threshold amount of pressure applied through activation line 480.

Although FIG. 4 illustrates utilizing activation line 480 to activate second diverter seat 460, in some embodiments, second diverter seat 460 and other diverter seats further uphole from second diverter seat 460 (not shown) are (sequentially) activated by an electrical signal. In some embodiments, second diverter seat 460 and other diverter seats further uphole from second diverter seat 460 are (sequentially) activated by acoustic signals transmitted through tubular 476 or from an acoustic device (not shown) deployed near tubular 476. In some embodiments, second diverter seat 460 and other diverter seats further uphole from second diverter seat 460 are activated after a period of time. For example, second diverter seat 460 is activated one hour (or another period of time) after a diverter lands on diverter seat 410 (or after another event or operation). Further, a diverter seat (not shown) in an adjacent zone further uphole is activated one hour or another period of time) after a second diverter lands on second diverter seat 460 (or after another event or operation). In some embodiments, completion system 420 includes covers, connectors, and ports of completion system 120' of FIG. 2'. The above detailed descriptions and illustrations of the foregoing components of completion system 120' are not replicated to describe and illustrate corresponding components of completion system 420 for the sake of brevity.

Figure 5:
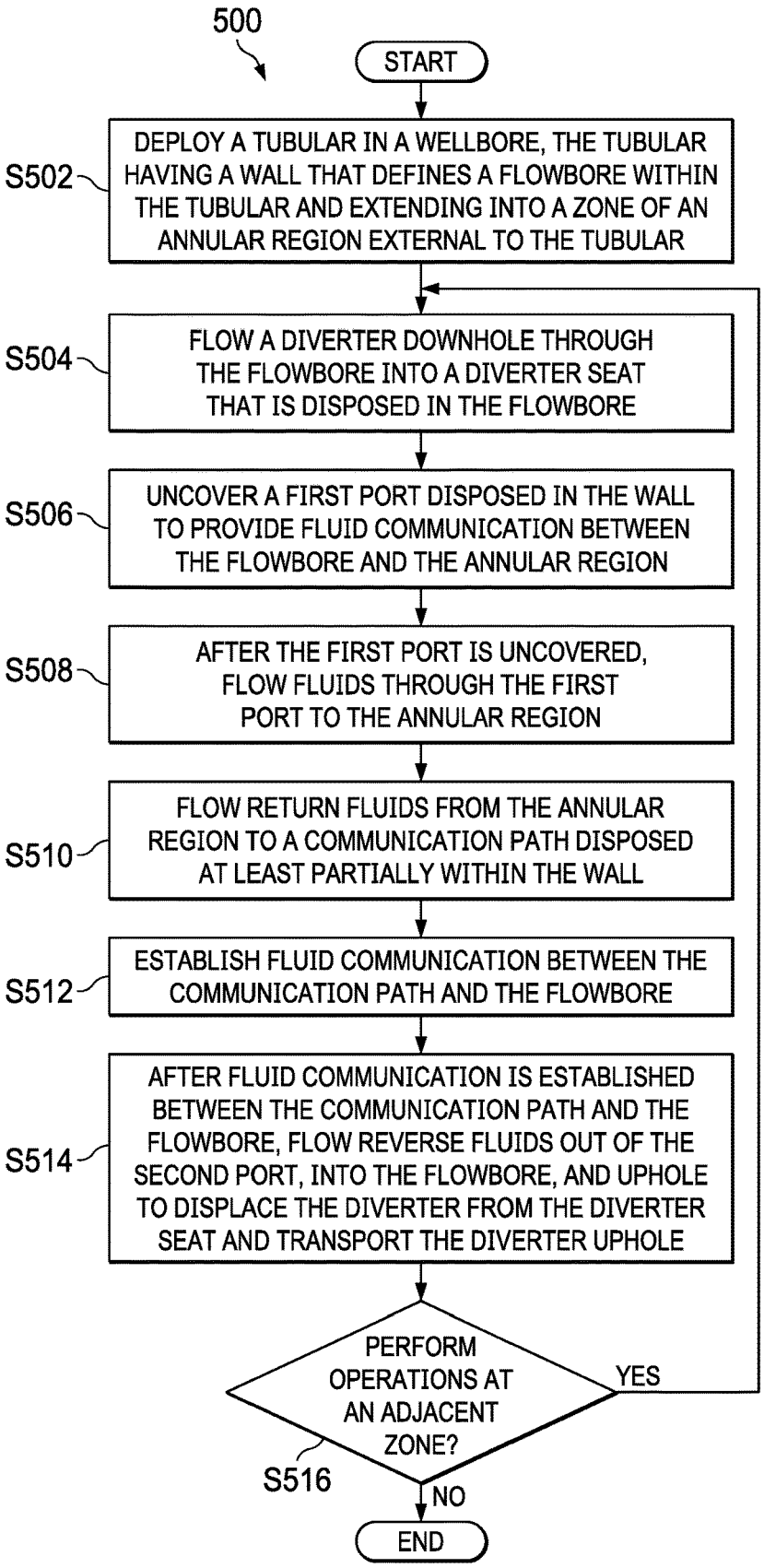
FIG. 5 is a flow chart illustrating a process to perform completion operations.

FIG. 5 is a flow chart of a process 500 to perform completion operations. Although the operations in process 500 are shown in a particular sequence, certain operations may be performed in different sequences or at the same time where feasible.

At block S502, a tubular is deployed in a wellbore, where the tubular has a wall that defines a flowbore within the tubular and extends into a zone of an annular region external to the tubular. FIG. 1, for example, illustrates tubular 116 deployed in wellbore 114. As shown in FIG. 1, flowbore 117 is formed within interior walls of tubular 116. Further, tubular 116 extends through zones 111A-111C of annular region 125 that is formed between tubular 116 and wellbore 114. At block S504, a diverter downhole flows through the flowbore into a diverter seat that is disposed in the flowbore. FIGS. 3A-3B, for example, illustrate flowing ball 301 through flowbore 117 downhole, as indicted by arrow 302, where ball 301 eventually lands on diverter seat 210 of FIGS. 3A and 3B.

At block S506, a first port disposed in the wall is uncovered to provide fluid communication between the flowbore and the annular region. FIG. 3B, for example, illustrates ball 301 landing on diverter seat 210. Further, the force generated from ball 301 landing on diverter seat 210 shifts cover 212 in a downhole direction as indicated by arrow 308, thereby uncovering first port 202. At block S508, after the first port is uncovered, fluids flow through the first port to the annular region. FIG. 3C, for example, illustrates a slurry flowing from flowbore 117 into first port 202 as indicated by arrow 314. At block S510, return fluids flow from the annular region to a communication path disposed at least partially within the wall. FIG. 3C, for example, illustrates a return fluid flowing from zone 111A of the annular region, through filter 208, and into second tubular 209. The return fluid then flows from second tubular 209, through restrictor 211, and into communication path 227 at location 248.

At block S512, fluid communication between the communication path and the flowbore is established through a second port. FIGS. 3A-3B, for example, illustrate shifting cover 212 from a first position illustrated in FIG. 3A to a second position illustrated in FIG. 3B to uncover second port 204. Further, FIGS. 3C-3D illustrate shifting cover 214 from a first position illustrated in FIG. 3C to a second position illustrated in FIG. 3D to establish fluid communication from path 227, through connectors 203 and 205, to second port 204, and through second port 204 to flowbore 117. FIGS. 3C'-3D' illustrate another embodiment where second port 204 is uncovered to establish fluid communication between communication path 227 and flowbore 117. More particularly, FIGS. 3C'-3D', illustrate shifting cover 215 from a first position illustrated in FIG. 3C' to a second position illustrated in FIG. 3D' to uncover second port 204, thereby providing fluid communication between communication path 227 and flowbore 117 through second port 204. At block S514, after fluid communication between the communication path and the flowbore is established through the second port, reverse fluids flow out of the second port, into the flowbore, and uphole to displace the diverter from the diverter seat and transport the diverter uphole. As shown in FIG. 3D, a reverse fluid in pumped downhole through communication path as indicated by arrow 322. The reverse fluid flows from communication path into second port 204, and from second port 204 into flowbore 117 as indicated by arrow 324. Pressure from the reverse fluid flowing uphole dislodges ball 301 from diverter seat 210 and flows ball 301 uphole in a direction illustrated by arrow 326.

At block S516, a determination of whether to perform the operations performed at blocks S504, S506, S508, S510, S512, and S514 at an adjacent zone (e.g., zone 111B of FIG. 1) is made. The process proceeds to block S504 in response to a determination to perform the operations at an adjacent zone. For example, in response to a determination to perform completion operations at zone 111B, a second diverter (not shown) is deployed downhole through flowbore 117 into diverter seat 260 of FIG. 2. Pressure applied by the second diverter landing on diverter seat 260 shifts cover 262, thereby uncovering first port 252 of FIG. 2 to provide fluid communication between flowbore 117 and the annular region at zone 111B of FIG. 2. After first port 252 is uncovered, a slurry, similar to the slurry illustrated in FIG. 3C, flows through first port 252 to the annular region at zone 111B. Return fluids flow from the annular region at zone 111B to communication path 227. Fluid communication between communication path 227 and flowbore 117 is subsequently established through second port 204 to reverse out the second diverter. In some embodiments, where completion system 120 includes additional zones, operations performed at blocks S504, S506, S508, S510, S512, and S514 are repeated to perform completion operations at each zone until all of the completion operations are complete at every zone. Alternatively, the process ends in response to a determination at block S516 not to perform the operations in an adjacent zone.

Figure 6:
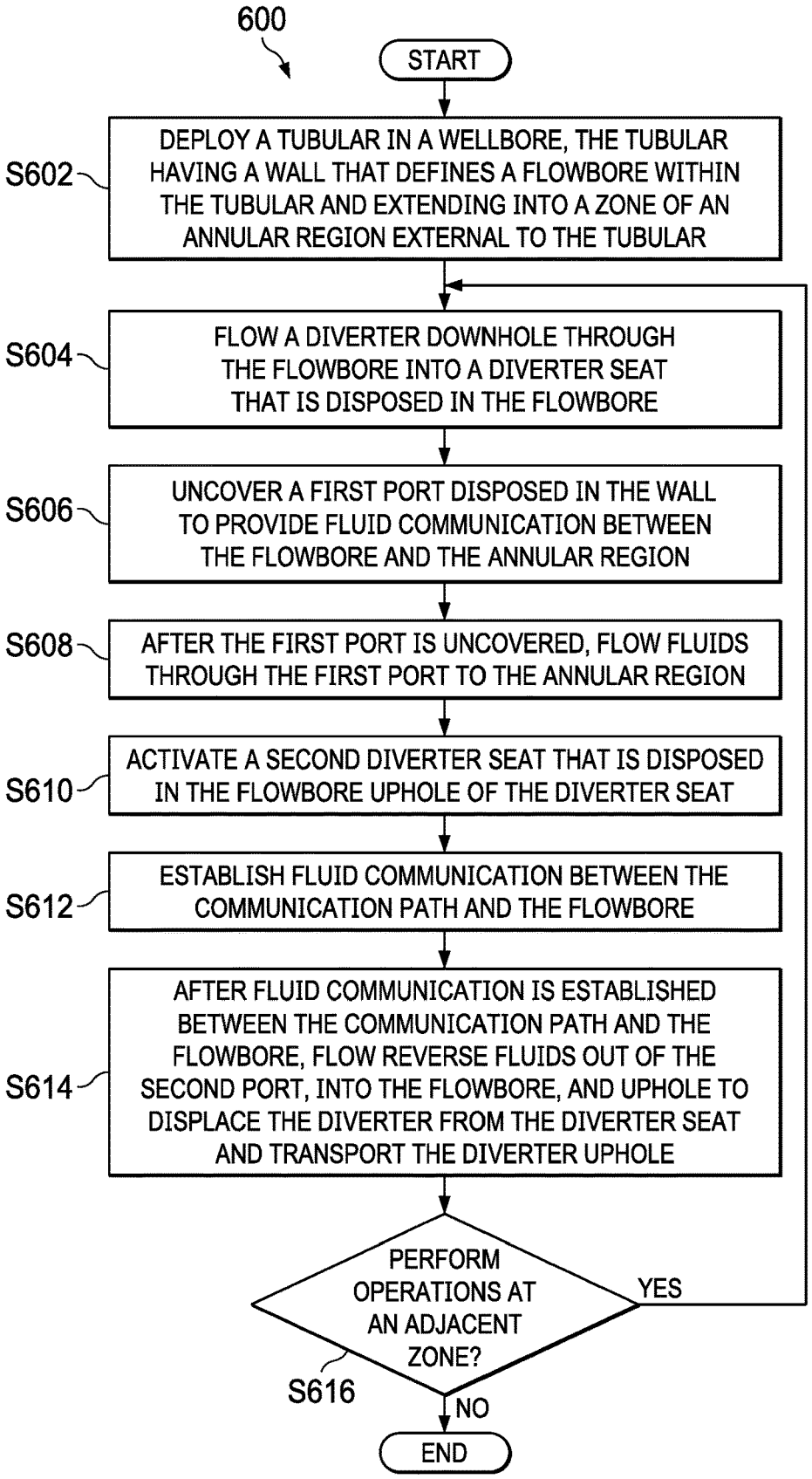
FIG. 6 is a flow chart illustrating another process to perform completion operations.

FIG. 6 is a flow chart of a process 600 to perform completion operations. Although the operations in process 600 are shown in a particular sequence, certain operations may be performed in different sequences or at the same time where feasible.

At block S602, a tubular is deployed in a wellbore, where the tubular has a wall that defines a flowbore within the tubular and the tubular extends into a zone of an annular region external to the tubular. At block S604, a diverter flows downhole through the flowbore into a first diverter seat that is disposed in the flowbore. At block S606, a first port is uncovered to provide fluid communication between the flowbore and the annular region. At block S608, after the first port is uncovered, fluids flow through the first port to the annular region. The operations performed at blocks S602, S604, S606, and S608 are similar to the operations performed at blocks S502, S504, S506, and S508 of process 500, which are described in the paragraphs above.

At block S610, a second diverter seat that is disposed in the flowbore uphole of the diverter seat is activated. FIG. 4, for example, illustrates activation line 480 that is disposed within the wall of tubular 476 configured to activate second diverter seat 460 in response to a threshold amount of pressure applied though activation line 460. In some embodiments, second diverter seat 460 is activated by an electrical signal transmitted from an electronic device that is deployed downhole or on the surface. In some embodiments, second diverter seat 460 is activated by an acoustic signal transmitted from an acoustic device transmitted from an acoustic device that is deployed downhole or on the surface. In some embodiments, second diverter seat 460 is activated after a threshold period of time after an operation or event. At block S612, similar to block S512, and after activating the second diverter seat, fluid communication is established between a communication path and the flowbore through the second port. At block S614, after fluid communication is established between the communication path and the flowbore through the second port, reverse fluids flow out of the second port, into the flowbore, and uphole to displace the diverter from the diverter seat and transport the diverter uphole. In the embodiment of FIG. 4, the diverter flows uphole through second diverter seat 460 towards the surface.

At block S616, a determination of whether to perform the operations performed at blocks S604, S606, S608, S610, S612, and S614 at an adjacent zone (e.g., zone 111B) is made. The process proceeds to block S604 in response to a determination to perform the operations at an adjacent zone. In one or more embodiments, where a determination is made to perform the operations at an adjacent zone, a second diverter is deployed downhole, where the second diverter flows through flowbore 477 of FIG. 4 and lands on diverter 460 of FIG. 4. Alternatively, the process ends in response to a determination at block S616 not to perform the operations in an adjacent zone.

It is understood that the shapes and dimensions of the components of completion system 120 that are illustrated in the figures are shown for illustration purposes. In some embodiments, one or more components of completion system 120 have different shapes and dimensions than what is illustrated in the figures.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a completion system, comprising: a tubular having a wall that defines a flowbore within the tubular and extending into a zone of an annular region external to the tubular; a first port disposed in the wall and configured to provide fluid communication between the flowbore and the annular region; a communication path disposed at least partially within the wall and configured to provide fluid communication with an annulus of a well outside of the zone; a second port disposed in the wall and configured to provide fluid communication between the flowbore and the communication path; a cover disposed over the second port and configured to prevent fluid communication during a fracturing operation; and a diverter seat disposed in the flowbore of the tubular uphole of the second port.

Clause 2, the completion system of clause 1, further comprising: a second cover positioned along the wall and configured to cover the first port in a first position of the second cover and uncover the first port in a second position of the second cover, wherein the cover is positioned along the wall and configured to cover the second port in a first position of the cover and uncover the second port in a second position of the cover.

Clause 3, the completion system of clause 2, wherein the cover is a first sleeve configured to shift from the first position of the first sleeve to the second position of the first sleeve to uncover the second port, and wherein the second cover is a second sleeve configured to shift from the first position of the second sleeve to the second position of the second sleeve to uncover the first port.

Clause 4, the completion system of clause 3, wherein the second sleeve is configured to shift from the first position of the second sleeve to the second position of the second sleeve to prevent fluid communication through the communication path downhole from the second sleeve.

Clause 5, the completion system of clauses 3 or 4, wherein the second sleeve is configured to shift from the first position of the second sleeve to the second position of the second sleeve to provide fluid communication between the communication path and a second tubular configured to provide fluid communication from the annular region to the communication path.

Clause 6, the completion system of any of clauses 3-5, wherein the second sleeve is configured to shift from the first position of the second sleeve to the second position of the second sleeve to provide fluid communication between the communication path and a flow path configured to provide fluid communication from the annular region to the communication path.

Clause 7, the completion system of any of clauses 3-6, wherein the first sleeve is configured to shift from the first position of the first sleeve to the second position of the first sleeve to cover the first port.

Clause 8, the completion system of any of clauses 1-7, wherein the cover is configured to shift in a downhole direction to uncover the second port, and wherein the cover is configured to shift in a downhole direction to cover the first port.

Clause 9, the completion system of any of clauses 1-7, wherein the cover is configured to shift in an uphole direction to uncover the second port, and wherein the second cover is configured to shift in an uphole direction to cover the first port.

Clause 10, the completion system of any of clauses 1-9, wherein the cover is positioned along the wall and is configured to not cover the first port in a first position and configured to cover the first port in a second position of the cover.

Clause 11, the completion system of any of clauses 1-11, further comprising a second tubular configured to provide fluid communication from the annular region to the communication path.

Clause 12, the completion system of clause 11, further comprising a filter that prevents solid particles greater than a threshold size from flowing into at least one of the second tubular and a production port.

Clause 13, the completion system of clause 12, further comprising a flow restrictor that is fluidly connected to the second tubular to permit fluid flow in one direction and inhibit fluid flow in a second and opposite direction.

Clause 14, the completion system of any of clauses 1-13, wherein the communication path is partially formed from a plurality of tubes that straddle one or more filters of the completion system, a plurality of concentric pipes, and a plurality of machined flow paths through one or more sleeves of the completion system.

Clause 15, the completion system of any of clauses 1-14, wherein the communication path is configured to flow fluid in uphole and downhole directions.

Clause 16, the completion system of clause 1, further comprising: a production port disposed in the wall and configured to provide fluid communication between the flowbore and the annular region; and a second cover positioned along the wall and configured to cover the production port in a first position and configured to uncover the production port in a second position.

Clause 17, the completion system of any of clauses 1-16, wherein the diverter seat is at least one of a ball seat, a dart seat, and a plug seat.

Clause 18, the completion system of any of clauses 1-17, wherein the flowbore extends into a second zone of the annular region that is adjacent to and uphole of the zone, and the completion system further comprising: a third port disposed in the wall and configured to provide fluid communication between the flowbore and the second zone of the annular region; a fourth port disposed in the wall and configured to provide fluid communication between the flowbore and the communication path in the second zone; and a second diverter seat disposed in the flowbore uphole of the fourth port.

Clause 19, the completion system of clause 18, further comprising: a first set of isolation devices disposed in the zone of the annular region; and a second set of isolation devices disposed in the second zone of the annular region and configured to isolate the second zone of the annular region.

Clause 20, a method to perform a completion operation, comprising: deploying a tubular in a wellbore, the tubular having a wall that defines a flowbore within the tubular and extending into a zone of an annular region external to the tubular; flowing a diverter downhole through the flowbore into a diverter seat that is disposed in the flowbore; uncovering a first port disposed in the wall to provide fluid communication between the flowbore and the annular region; after uncovering the first port, flowing fluids through the first port to the annular region; flowing return fluids from the annular region to a communication path disposed at least partially within the wall; establishing fluid communication between the communication path and the flowbore through a second port; and after establishing fluid communication between the communication path and the flowbore through second port, flowing reverse fluids out of the second port, into the flowbore, and uphole to displace the diverter from the diverter seat and transport the diverter uphole.

Clause 21, the method of clause 20, further comprising: shifting a first cover positioned along the wall from a first position of the first cover to a second position of the first cover to uncover the first port; and shifting a second cover positioned along the wall from a first position of the second cover to a second position of the second cover to uncover the second port.

Clause 22, the method of clause 21, wherein the first cover is a first sleeve, the method further comprising shifting the first sleeve from the first position of the first sleeve to the second position of the first sleeve to prevent fluid communication through the communication path.

Clause 23 method of clauses 21 or 22, wherein the first cover is a first sleeve, the method further comprising shifting the first sleeve from the first position of the first sleeve to the second position of the first sleeve to provide fluid communication between the communication path and a second tubular that provides fluid communication from the annular region to the communication path.

Clause 24, the method of any of clauses 21-23, wherein the second cover is a second sleeve, the method further comprising shifting the second sleeve from the first position of the second sleeve to the second position of the second sleeve to cover the first port.

Clause 25, the method of any of clauses 20-24, further comprising: shifting a first cover positioned along the wall from a first position of the first cover to a second position of the first cover to uncover the first port; shifting a second cover positioned along the wall from a first position of the second cover to a second position of the second cover to cover the first port; and shifting a third cover positioned along the wall from a first position of the third cover to a second position of the third cover to uncover the second port.

Clause 26, the method of clause 25, further comprising applying pressure through the communication path to deploy one or more isolation devices disposed in the zone of the annular region to isolate the zone.

Clause 27, the method of clauses 25 or 26, further comprising flowing the return fluids from the annular region into a second tubular to provide fluid communication from the annular region to the communication path.

Clause 28, the method of any of clauses 25-27, further comprising: after displacing the diverter from the diverter seat, uncovering a third port disposed in the wall to provide fluid communication between the flowbore and the annular region; and flowing production fluids through the third port and into the flowbore.

Clause 29, the method of any of clauses 25-28, further comprising: flowing a second diverter downhole through the flowbore into a second diverter seat that is disposed in a section of the flowbore that extends into a second zone of the annular region; uncovering a third port disposed in the wall to provide fluid communication between the flowbore and the second zone of the annular region; after uncovering the third port, flowing fluids through the third port to the second zone of the annular region; flowing return fluids from the second zone of the annular region to the communication path; uncovering a fourth port disposed in the wall to provide fluid communication between the communication path and the flowbore; and after uncovering the fourth port, flowing the reverse fluids out of the fourth port, into the flowbore, and uphole to displace the second diverter from the second diverter seat and transport the second diverter uphole.

Clause 30, the method of any of clauses 25-29, further comprising disconnecting a running tool from the completion system to increase a flow rate of the reverse fluids.

Clause 31, a completion system, comprising: a tubular having a wall that defines a flowbore within the tubular and extending into a zone of an annular region external to the tubular; a first port disposed in the wall and configured to provide fluid communication between the flowbore and the annular region; a communication path disposed at least partially within the wall and configured to provide fluid communication with an annulus of a well outside of the zone; a filter configured to prevent solid particles greater than a threshold size from flowing into the communication path; a second port disposed in the wall and configured to provide fluid communication between the flowbore and the communication path; and a diverter seat disposed in the flowbore of the tubular uphole of the second port.

As used herein, a "downhole direction" refers to a direction that extends from a location of a wellbore further into the wellbore and away from the surface, whereas an "uphole direction" refers to a direction that extends from a location of the wellbore towards the surface. In that regard a first zone that is downhole from a second zone is further away from the surface than the second zone. Similarly, a second zone that is uphole from a first zone is a zone that is closer towards the surface than the second zone. Further, as used herein, a "bottom zone" refers to the furthest zone from the surface. As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A completion system, comprising:

a tubular having a wall that defines a flowbore within the tubular and extending into a zone of an annular region external to the tubular;

a first port disposed in the wall and configured to provide fluid communication between the flowbore and the annular region;

a communication path disposed at least partially within the wall and configured to provide fluid communication with an annulus of a well outside of the zone;

a second port disposed in the wall and configured to provide fluid communication between the flowbore and the communication path;

a cover disposed over the second port and configured to prevent fluid communication during a fracturing operation;

a second tubular configured to provide fluid communication from the annular region to the communication path; and a diverter seat disposed in the flowbore of the tubular uphole of the second port.

2. The completion system of claim 1, further comprising:

a second cover positioned along the wall and configured to cover the first port in a first position of the second cover and uncover the first port in a second position of the second cover, wherein the cover is positioned along the wall and configured to cover the second port in a first position of the cover and uncover the second port in a second position of the cover.

3. The completion system of claim 2, wherein the cover is a first sleeve configured to shift from the first position of the first sleeve to the second position of the first sleeve to uncover the second port, and wherein the second cover is a second sleeve configured to shift from the first position of the second sleeve to the second position of the second sleeve to uncover the first port.

4. The completion system of claim 3, wherein the second sleeve is configured to shift from the first position of the second sleeve to the second position of the second sleeve to prevent fluid communication through the communication path downhole from the second sleeve.

5. The completion system of claim 3, wherein the second sleeve is configured to shift from the first position of the second sleeve to the second position of the second sleeve to provide fluid communication between the communication path and the second tubular configured to provide fluid communication from the annular region to the communication path.

6. The completion system of claim 3, wherein the second sleeve is configured to shift from the first position of the second sleeve to the second position of the second sleeve to provide fluid communication between the communication path and a flow path configured to provide fluid communication from the annular region to the communication path.

7. The completion system of claim 3, wherein the first sleeve is configured to shift from the first position of the first sleeve to the second position of the first sleeve to cover the first port.

8. The completion system of claim 1, wherein the cover is configured to shift in a downhole direction to uncover the second port, and wherein the cover is configured to shift in the downhole direction to cover the first port.

9. The completion system of claim 1, wherein the cover is configured to shift in an uphole direction to uncover the second port, and wherein the second cover is configured to shift in the uphole direction to cover the first port.

10. The completion system of claim 1, wherein the cover is positioned along the wall and is configured to not cover the first port in a first position and configured to cover the first port in a second position of the cover.

11. The completion system of claim 1, further comprising a filter that prevents solid particles greater than a threshold size from flowing into at least one of the second tubular and a production port.

12. The completion system of claim 11, further comprising a flow restrictor that is fluidly connected to the second tubular to permit fluid flow in one direction and inhibit fluid flow in a second and opposite direction.

13. The completion system of claim 1, wherein the communication path is partially formed from a plurality of tubes that straddle one or more filters of the completion system, a plurality of concentric pipes, and a plurality of machined flow paths through one or more sleeves of the completion system.

14. The completion system of claim 1, wherein the communication path is configured to flow fluid in uphole and downhole directions.

15. The completion system of claim 1, further comprising:

a production port disposed in the wall and configured to provide fluid communication between the flowbore and the annular region; and a second cover positioned along the wall and configured to cover the production port in a first position and configured to uncover the production port in a second position.

16. The completion system of claim 1, wherein the diverter seat is at least one of a ball seat, a dart seat, and a plug seat.

17. The completion system of claim 1, wherein the flowbore extends into a second zone of the annular region that is adjacent to and uphole of the zone, and the completion system further comprising:

a third port disposed in the wall and configured to provide fluid communication between the flowbore and the second zone of the annular region;

a fourth port disposed in the wall and configured to provide fluid communication between the flowbore and the communication path in the second zone; and a second diverter seat disposed in the flowbore uphole of the fourth port.

18. The completion system of claim 17, further comprising:

a first set of isolation devices disposed in the zone of the annular region; and a second set of isolation devices disposed in the second zone of the annular region and configured to isolate the second zone of the annular region.

19. A method to perform a completion operation, comprising:

deploying a tubular in a wellbore, the tubular having a wall that defines a flowbore within the tubular and extending into a zone of an annular region external to the tubular;

flowing a diverter downhole through the flowbore into a diverter seat that is disposed in the flowbore;

uncovering a first port disposed in the wall to provide fluid communication between the flowbore and the annular region;

after uncovering the first port, flowing fluids through the first port to the annular region;

flowing return fluids from the annular region to a second tubular configured to provide fluid communication from the annular region to a communication path disposed at least partially within the wall;

flowing the return fluids from the second tubular to the communication path;

establishing fluid communication between the communication path and the flowbore through a second port; and after establishing fluid communication between the communication path and the flowbore through the second port, flowing reverse fluids out of the second port, into the flowbore, and uphole to displace the diverter from the diverter seat and transport the diverter uphole.

20. The method of claim 19, further comprising:

shifting a first cover positioned along the wall from a first position of the first cover to a second position of the first cover to uncover the first port; and shifting a second cover positioned along the wall from a first position of the second cover to a second position of the second cover to uncover the second port.

21. The method of claim 20, wherein the first cover is a first sleeve, the method further comprising shifting the first sleeve from the first position of the first sleeve to the second position of the first sleeve to provide fluid communication between the communication path and the second tubular that provides fluid communication from the annular region to the communication path.

22. The method of claim 20, wherein the second cover is a second sleeve, the method further comprising shifting the second sleeve from the first position of the second sleeve to the second position of the second sleeve to cover the first port.

23. The method of claim 20, wherein the first cover is a first sleeve, the method further comprising shifting the first sleeve from the first position of the first sleeve to the second position of the first sleeve to prevent fluid communication through the communication path.

24. The method of claim 19, further comprising:

shifting a first cover positioned along the wall from a first position of the first cover to a second position of the first cover to uncover the first port;

shifting a second cover positioned along the wall from a first position of the second cover to a second position of the second cover to cover the first port; and shifting a third cover positioned along the wall from a first position of the third cover to a second position of the third cover to uncover the second port.

25. The method of claim 24, further comprising applying pressure through the communication path to deploy one or more isolation devices disposed in the zone of the annular region to isolate the zone.

26. The method of claim 24, further comprising flowing the return fluids from the annular region into the second tubular to provide fluid communication from the annular region to the communication path.

27. The method of claim 24, further comprising:

after displacing the diverter from the diverter seat, uncovering a third port disposed in the wall to provide fluid communication between the flowbore and the annular region; and flowing production fluids through the third port and into the flowbore.

28. The method of claim 24, further comprising:

flowing a second diverter downhole through the flowbore into a second diverter seat that is disposed in a section of the flowbore that extends into a second zone of the annular region;

uncovering a third port disposed in the wall to provide fluid communication between the flowbore and the second zone of the annular region;

after uncovering the third port, flowing fluids through the third port to the second zone of the annular region;

flowing the return fluids from the second zone of the annular region to the communication path;

uncovering a fourth port disposed in the wall to provide fluid communication between the communication path and the flowbore; and after uncovering the fourth port, flowing the reverse fluids out of the fourth port, into the flowbore, and uphole to displace the second diverter from the second diverter seat and transport the second diverter uphole.

29. The method of claim 24, further comprising disconnecting a running tool from the completion system to increase a flow rate of the reverse fluids.

30. A completion system, comprising:

a tubular having a wall that defines a flowbore within the tubular and extending into a zone of an annular region external to the tubular;

a first port disposed in the wall and configured to provide fluid communication between the flowbore and the annular region;

a communication path disposed at least partially within the wall and configured to provide fluid communication with an annulus of a well outside of the zone;

a filter configured to prevent solid particles greater than a threshold size from flowing into the communication path;

a second port disposed in the wall and configured to provide fluid communication between the flowbore and the communication path;

a second tubular configured to provide fluid communication from the annular region to the communication path; and a diverter seat disposed in the flowbore of the tubular uphole of the second port.

* * * * *